US005302502A

United States Patent [19]

Shibata

[11] Patent Number: 5,302,502

[45] Date of Patent: Apr. 12, 1994

[54] SILVER HALIDE COLOR PHOTOGRAPHIC MATERIAL

[75] Inventor: Yoshinori Shibata, Kanagawa, Japan

[73] Assignee: Fuji Photo Film Co., Ltd., Minami-ashigara, Japan

[21] Appl. No.: 996,473

[22] Filed: Dec. 23, 1992

Related U.S. Application Data

[63] Continuation of Ser. No. 798,060, Nov. 27, 1991, abandoned, which is a continuation of Ser. No. 285,384, Dec. 16, 1988, abandoned, which is a continuation-in-part of Ser. No. 856,264, Apr. 25, 1986, abandoned.

[30] Foreign Application Priority Data

Apr. 25, 1985 [JP] Japan ..... 60-89651

[51] Int. Cl.[5] ..... G03C 7/38; G03C 1/035

[52] U.S. Cl. ..... 430/546; 430/548; 430/558; 430/567; 430/611; 430/613; 430/569

[58] Field of Search ..... 430/558, 567, 569, 546, 430/548, 611, 613

[56] References Cited

U.S. PATENT DOCUMENTS

| | | | |
|---|---|---|---|
| 4,221,863 | 9/1980 | Overman et al. | 430/567 |
| 4,284,717 | 8/1981 | Toya et al. | 430/567 |
| 4,500,630 | 2/1985 | Sato et al. | 430/558 |
| 4,585,732 | 4/1986 | Kawagishi et al. | 430/558 |
| 4,622,287 | 11/1986 | Umemoto et al. | 430/558 |
| 4,686,178 | 8/1987 | Honda et al. | 430/567 |
| 4,720,452 | 1/1988 | Takiguchi et al. | 430/567 |
| 4,830,956 | 5/1989 | Waki | 430/558 |

FOREIGN PATENT DOCUMENTS

| | | | |
|---|---|---|---|
| 0090479 | 10/1983 | European Pat. Off. | 430/558 |

OTHER PUBLICATIONS

James, T. H. The Theory of the Photographic Process 4th Edition 1977, pp. 98–100.

*Primary Examiner*—Lee C. Wright

*Attorney, Agent, or Firm*—Sughrue, Mion, Zinn, Macpeak & Seas

[57] ABSTRACT

A novel silver halide color photographic material is provided which is excellent in color reproduction and color image fastness, and shows only small variations in gradation due to fluctuaion in treatment conditions such as treatment composition, time, and temperature. The present silver halide color photographic material has a pyrazoloazole coupler and silver halide grains consisting of regular crystals with a twin content of 5% or less, said silver halide grains being represented by the formula:

$$AgCl_xBr_yI_{1-x-y}$$

wherein x and y satisfy the relationships $0 \leqq x < 1$, $0 \leqq y \leqq 1$, and $0 \leqq 1-x-y \leqq 0.02$.

In preferred embodiments of the present invention, said pyrazoloazole coupler is represented by the general formula:

wherein $R_1$ represents a hydrogen atom or a substituent group; X represents a hydrogen atom or a group which can be liberated by a coupling reaction with an oxide of an aromatic primary amine developing agent; and Za, Zb and Zc each represent a methine, substituted methine, =N— or —NH—, with the proviso that one of Za—Zb bond and Zb—Zc bond is a double bond and the other a single bond and that a condensation may occur at Zb—Zc bond to form an aromatic ring. The regular crystals comprises cubic, rhombic dodecahedral, regular octahedral, and tetradecahedral grains. The coefficient of variation of particle size of silver halide is preferably 25% or less, more preferably 20% or less. The average particle size of the silver halide is preferably 0.2 to 0.9 μm, more preferably 0.3 to 0.7 μm.

30 Claims, 4 Drawing Sheets

TREATMENT SOLUTION WHICH HAS TREATED 400 m2

E : C.M.S.

SILVER HALIDE COLOR PHOTOGRAPHIC MATERIAL

This is a continuation of application Ser. No. 07/798,060, filed Nov. 27, 1991, now abandoned, which is a continuation of application Ser. No. 07/285,384, filed Dec. 16, 1988, now abandoned, which is a continuation-in-part of application Ser. No. 06/856,264, filed Apr. 25, 1986, now abandoned.

FIELD OF THE INVENTION

The present invention relates to a silver halide color photographic material More particularly, the present invention relates to a silver halide color photographic material which is excellent in color reproduction and color image fastness and has a small fluctuation in gradation due to fluctuation in treatment conditions such as treatment composition, time and temperature.

BACKGROUND OF THE INVENTION

It is known that a silver halide color photographic materials provide a desired image after being subjected to light exposure and development. Silver halide color photographic materials generally comprise a silver halide emulsion and a so-called dye forming coupler which reacts with an oxide of an aromatic primary amine developing agent to form a dye (hereinafter referred to simply as "coupler"). In particular, combinations of yellow coupler (i.e., a yellow-dye-forming coupler), cyan coupler, and magenta coupler are generally employed.

Magenta dyes obtained from 5-pyrazolone couplers which have heretofore been frequently used as magenta couplers are disadvantageous in that they have a side absorption in the range near 430 nm and a poor sharpness of absorption on the long-wavelength side of the absorption curve. Thus, such magenta dyes leave much to be desired in color reproduction.

In order to overcome these disadvantages, pyrazoloazole couplers have been developed. Magenta dyes obtained by the coupling of such a coupler with an oxide of an aromatic primary amine developing agent are advantageous in that they are free from side absorption in the range near 430 nm when they are in the form of a solution in ethyl acetate, and develop a highly pure magenta color excellent in sharpness of absorption on the long-wavelength side of the absorption curve. Furthermore, color images thus obtained are excellent in fastness to light.

On the other hand, one of the important requirements for silver halide color photographic materials is that they provide color image that is stable with respect to variations in development conditions. In the development process, for example, the developer composition of a so-called running solution varies with its history, i.e., the amount of light-sensitive materials which it has treated, the amount of developer supplemented, the structure of a treating machine, or the like. As a result of extensive studies, the present inventors have found that the formation of color images stably with respect to variations in treatment conditions can be evaluated by the degree of change in the sensitometry curve with the passage of color development time.

The present inventors have made intensive studies to improve the color image formation stability of silver halide color photographic materials against the above mentioned fluctuation in treatment conditions. As a result, the present inventors have found that the sensitivity change in sensitometry curve with the passage of color development time upon the treatment of a combination of a pyrazoloazole coupler and silver halide grains with an aromatic primary amine type developing agent is smaller than that shown upon the treatment of a combination of a 5-pyrazolone coupler and silver halide grains with the same developing agent. However, as the need for high quality color photographic materials has increased, the need to simplify and speed up the treatment of color light-sensitive materials, such as a silver halide color photographic material comprising the pyrazoloazole coupler, leaves much to be desired in its color image stability against the fluctuation in treatment conditions and adaptability to rapid treatment.

SUMMARY OF THE INVENTION

It is therefore an object of the present invention to provide a silver halide light-sensitive material having a small gradation change and a small sensitivity change in sensitometry curve with the passage of color development time upon the treatment with an aromatic primary amine as a developing agent.

The above and other objects of the present invention will become more apparent from the following detailed description and examples.

The present inventors have made intensive studies to develop a silver halide color photographic material which meets these requirements. As a result, the inventors have found that the sensitivity and gradation changes in sensitometry curves with the passage of color development time upon the treatment of a combination of a pyrazoloazole coupler and silver halide grains with an aromatic primary amine as a developing agent is affected by the crystal form of the silver halide grains in the silver halide emulsion.

Thus, the inventors have found that a combination of silver halide grains having a certain regular crystal form (rather than conventional irregular crystal form) and a pyrazoloazole coupler shows remarkably reduced sensitivity and gradation change in sensitometry curve with the passage of color development time. The present invention has been accomplished on the basis of this knowledge.

The present invention thus provides a silver halide color photographic material comprising a pyrazoloazole coupler and silver halide grains consisting of regular crystals with a twin content of 5% or less, said silver halide being represented by the formula (I)

$$AgCl_xBr_yI_{1-x-y} \quad (I)$$

wherein x and y satisfy the relationships $0 \leqq x \leqq 1$, $0 \leqq y \leqq 1$, and $0 \leqq 1-x-y \leqq 0.02$.

The above and other features and advantages of the present invention will become apparent from the following detailed description of the invention made with reference to the accompanying drawings which form a part of the specification.

PREFERRED EMBODIMENTS OF THE INVENTION

Figure 1:
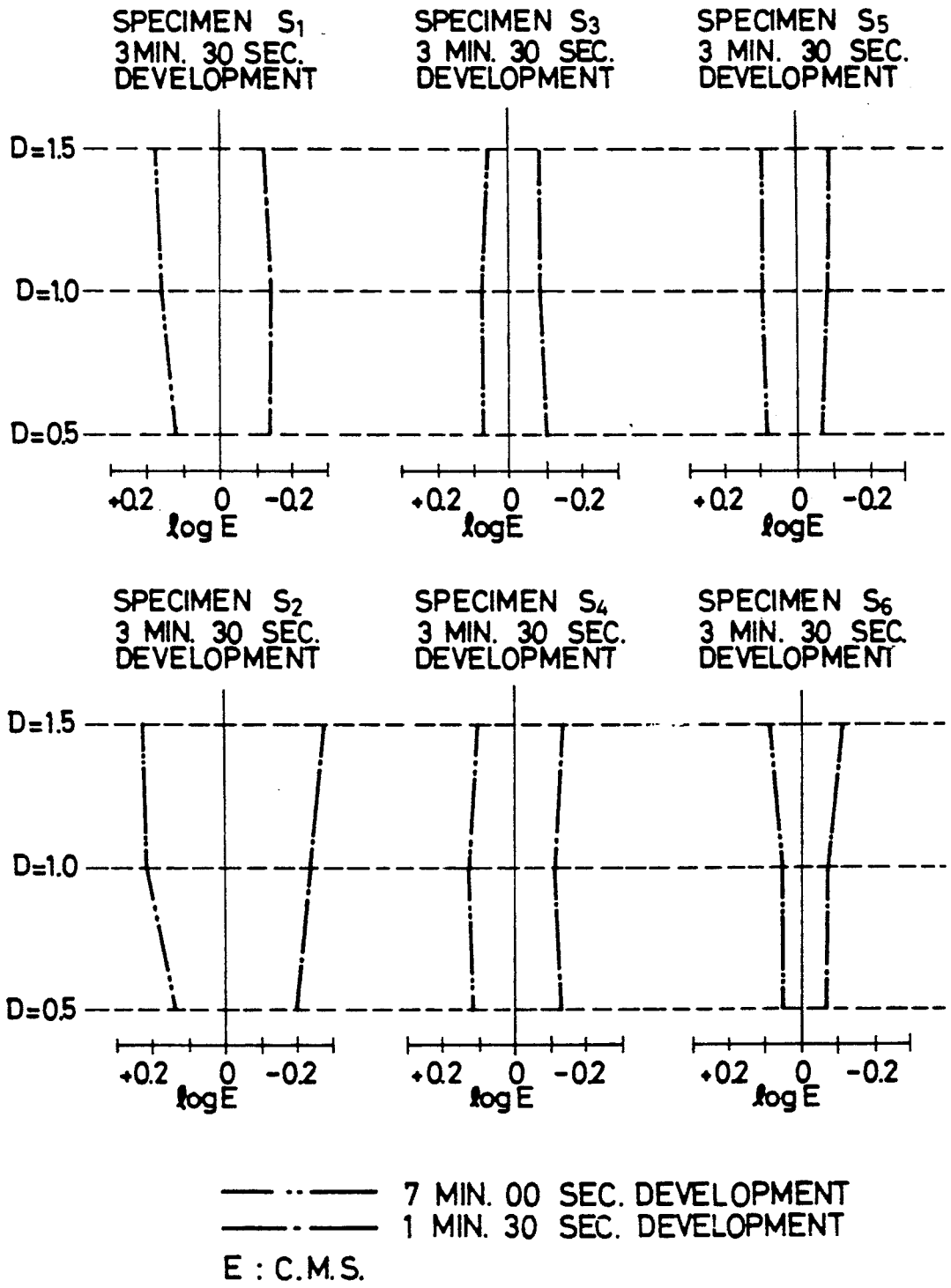
FIGS. 1, 3 and 5 show graph illustrating the relationship between the development time and sensitometry of silver halide color photographic materials.

The regular crystal forms of the silver halide grains as used in the present invention include cubic grains, which have an external shape surrounded by (100) planes, rhombic dodecahedral grains, which have an external shape surrounded by (110) pleanes, regular octahedral grains, which have an external shape surrounded by (111) planes, and tetradecahedral grains, which have an external shape surrounded by (100) and (111) planes.

In the present invention, the twin content of silver halide grains is determined by taking a picture of silver halide grains in the silver halide emulsion by means of replica method, classifying regular crystals and by crystals from the forms and shapes of the silver halide grains with respect to 600 or more grains and calculating the twin content according to the following equation:

$$\text{Twin Content} = \frac{\text{Number of Twins}}{\text{Total Number of Graind Examined}} \times 100\ (\%)$$

With respect to the classification of the form of twin crystals, reference is made to what is described in, e.g., H. J. Metz and E. Moisar; *Photograohische Korresoondenz* Vol. 99 (1963) pages 99 et seq., and ibid., Vol. 100 (1964) pages 57 et seq.

The coefficient of variation of particle size of the silver halide of the present invention is preferably 25% or less, more preferably 20% or less. The term "particle size" as used herein means the diameter of a circle having the same area as the projected area of the particle in electron microscope photography. The coefficient of variation is defined based on the following considerations.

Let us suppose that there are $n_1$ particles of size $d_1$, $n_2$ particles of size $d_2$, and so forth (i.e., $n_i$ particles of size $d_i$ wherein $$N = \sum_{i=1}^{k} n_i).$$

The coefficient of variation can be defined by the equation $$\textit{Coefficient of variation} = S/\bar{d} \times 100\%$$

wherein $$\bar{d} = \sum_{i=1}^{k} n_i d_i / N$$

and $$S = \left[ \frac{\sum_{i=1}^{k} n_i (d_i - \bar{d})^2}{N} \right]^{\frac{1}{2}}$$

When the coefficient of variation exceeds 25%, the sensitivity change and the gradation change in sensitometry curve with the passage of color development time become disadvantageously greater.

The twin content is 5% or less (result of measurement made for 277 or more particles), but is preferably as small as possible. When the twin content exceeds 5%, the sensitivity change and the gradation change in sensitometry curve with the passage of color development time become disadvantageously greater.

The average particle size $\bar{d}$ is preferably from 0.2 to 0.9 μm, and more preferably from 0.3 to 0.7 μm.

The average particle size $\bar{d}$ is determined based on the result of the measurement of 277 or more particles. The measurement is effected by electron microscope photography. When the average particle size is less than 0.2 μm, the effect of the gradation change with the passage of color development time becomes smaller. On the contrary, when the average particle size exceeds 0.9 μm, the greater particle size causes the development progress to be limited by the size of silver halide grains. This generally prevents the effect of the present invention from appearing clearly.

The preparation of a silver halide emulsion having a particle size distribution and crystal form thus controlled may be accomplished by forming silver halide grains in the presence of a silver halide solvent.

As such a silver halide solvent, there are known organic compounds, such as thioethers, amines, and thioureas as well as inorganic compounds such as ammonia and thiocyanates. Any of these compounds is useful. In particular, however, a silver halide emulsion having a regular crystal form and a substantially uniform particle size distribution can be obtained by using a thiourea compound represented by formula (X)

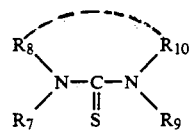

(X)

wherein $R_7$, $R_8$, $R_9$ and $R_{10}$ (which are the same or different) each represents an alkyl group having from 1 to 4 carbon atoms, or $R_8$ and $R_{10}$ tother form a 5- or 6-membered ring.

Examples of Thiourea Compounds

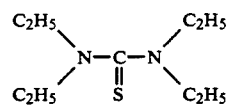

(1)

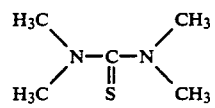

(2)

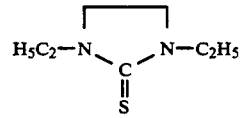

(3)

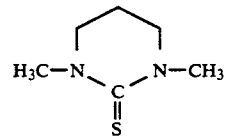

(4)

-continued (5)

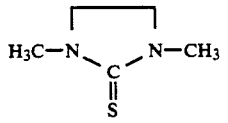

(6)

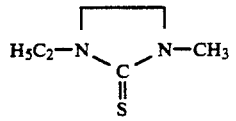

These compounds are preferably present at the time of formation of the silver halide particles in an amount of from $5\times10^{-3}$ to $5\times10^{-6}$ mol per mol of a silver halide precipitated.

In the present invention, it is preferred to use a silver chlorobromide emulsion containing 10 mol % or more silver bromide as a silver halide. In order to obtain a silver halide emulsion having a satisfactory sensitivity without increasing fog, it is preferred that the silver bromide content of the silver halide emulsion be 20 mol % or more. However, when rapid processing is desired it is sometimes preferred that the silver bromide contents of silver halode emulsion is 20 mol % or less, more preferably 10 mol % or less.

Preferable examples of pyrazoloazole couplers which may be used in the present invention include compounds represented by formula (II)

(II)

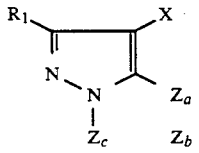

wherein $R_1$ represents a hydrogen atom or a substituent group; X represents a hydrogen atom or a group which can be liberated by a coupling reaction with an oxide of an aromatic primary amine developing agent; and Za, Zb, and Zc each represent a methine, a substituted methine, =N— or —NH—, provided that one of the Za—Zb bond and Zb—Zc bond is a double bond and the other a single bond and that said compound can be condensed with an aromatic ring such that the Zb—Zc bond can form one side of the condensed aromatic ring. Preferably $R^1$ has same meaning as $R^{11}$ hereinbelow.

The compounds of formula (II) include dimers or higher polymers wherein $R_1$ or X serves as a linking group and those wherein Za, Zb, or Zc, if it is a substituted methine, serves as a linking group.

Pyrazoloazole compounds which may be used in the present invention will be hereinafter described in greater detail.

The term "polymer" as used herein means one having two or more groups based on formula (II) in its molecule.

Such polymers include bis compounds and polymeric couplers. Preferably, the polymeric coupler has a molecular weight of from about 10,000 to about 200,000. Such polymeric couplers may be homopolymers of groups based on formula (II) (preferably having vinyl groups: such a monomer being hereinafter referred to as "vinyl monomer") or may be a copolymer of a monomer having a group based on formula (II) with a non-coloring ethylenic monomer which does not undergo coupling with an oxide of an aromatic primary amine developing agent.

Preferred among pyrazoloazole magenta couplers of the formula (II) are those represented by the formulae (III), (IV), (V), (VI), (VII), (VIII), and (IX).

(III)

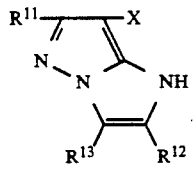

(IV)

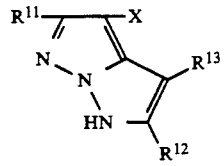

(V)

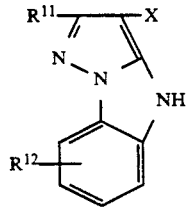

(VI)

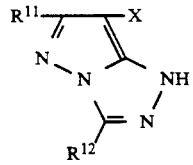

(VII)

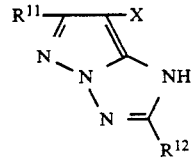

(VIII)

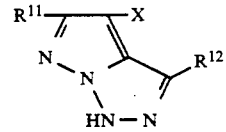

(IX)

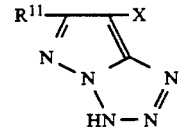

More preferable for the objects of the present invention among the couplers of formulae (III) to (IX) are those represented by formula (III), (VI) and (VII). Most preferable is the compound of formula (VII).

In formulae (III) to (IX), $R^{11}$, $R^{12}$, and $R^{13}$ (which may be the same or different) each represents a hydrogen atom, a halogen atom, an alkyl group, an aralkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido groups, an imido group, a sulfamoylamino group, a carbamoylamino group, an alkylthio group, an arylthio group, a heterocyclic thio group, an alkoxycarbonyl amino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group, and X represents a hydrogen atom, a halogen atom, a carboxy group or a group which is bonded to the carbon atom at the coupling position thereof via an oxygen, nitrogen, or sulfur atom and liberated upon coupling, or $R^{11}$, $R^{12}$, $R^{13}$, or X may be a divalent group to form a bis compound.

The pyrazoloazole magenta coupler of formula (II) may be in the form of a polymeric coupler which comprises coupler residual groups of formulae (III) to (IX) present in the main polymeric chain or a side chain thereof. In particular, polymers derived from vinyl monomers having portions of these formulas are preferred. In this case, $R^{11}$, $R^{12}$, $R^{13}$ or X represents a vinyl group or a linking group. The number of total carbon atoms of $R^{11}$, $R^{12}$ and $R^{13}$ altogether is preferably about 10 to about 100 per pyrazoloazole ring.

More particularly, $R^{11}$, $R^{12}$, and $R^{13}$ each represent a hydrogen atom, a halogen atom such as chlorine and bromine, an alkyl group such as a methyl group, a t-butyl group, a trifluoromethyl group, atridecyl group, a 3-(2,4- di-t-amylphenoxy)propyl group, an allyl group, a 2-dodecyloxyethyl group, a 3-phenoxypropyl group, a 2-hexylsulfonylethyl group, and a cyclopentyl group, an aralkyl group such as a benzyl group, an aryl group such as a phenyl group, a 4-t-butylphenyl group, a 2,4-di-t-amylphenyl group, and a 4-tetradecanamidophenyl group, a heterocyclic group such as a 2-furyl group, a 2-thienyl group, a 2-pyrimidinyl group, and a 2-benzothiazolyl group, a cyano group, an alkoxy group such as a methoxy group, an ethoxy group, a 2-methoxyethoxy group, a 2-dodecyloxyethoxy group, and a 2-methanesulfonylethoxy group, an aryloxy group such as a phenoxy group, a 2-methylphenoxy group and a 4-t-butylphenoxy group, a heterocyclic oxy group such as a 2-benzimidazolyloxy group, an acyloxy group such as an acetoxy group and a hexadecanoyloxy group, a carbamoyloxy group such as an N-phenylcarbamoyloxy group and an N-ethylcarbamoyloxy group, a silyloxy group such as a trimethylsilyloxy group, a sulfonyloxy group such as a dodecylsulfonyloxy group, an acylamino group such as an acetamido group, a benzamido group, a tetradecanamido group, an α-(2,4-di-t-amylphenoxy)butyramido group, a γ-(3-t-butyl4-hydroxyphenoxy)butyramido group, and an α-[4-(4-hydroxyphenylsulfonyl)phenoxy]decanamido group, an anilino group such as a phenylamino group, a 2-chloroanilino group, a 2-chloro-5-tetradecanamidoanilino group, a 2-chloro-5-dodecyloxycarbonylanilino group, an N-acetylanilino group, and a 2-chloro-5-[α-(3-t-butyl-4-hydroxyphenoxy)-dodecanamido]anilino group, a ureido group such as a phenylureido group, a methylureido group, and an N,N-dibutylureido group, an imido group such as an N-succinimido group, a 3-benzylhydantoinyl group, and a 4-(2-ethylhexanoylamino)phthalimido group, a sulfamoyl group such as an N,N-diptopylsulfamoylamino group, ana an N-methyl-N-decylsulfamoylamido group, a carbamoylamino group such as an N,N-dibutylcarbamoylamino group, and an N-methyl-N-decylcarbamoylamino group, an alkylthio group such as a methylthio group, an octylthio group, a tetradecylthio group, a 2-phenoxyethylthio group, a 3-phenoxypropylthio group, and a 3-(4-t-butylphenoxy)-propylthio group, an arylthio group such as a phenylthio group, a 2-butoxy-5-t-octylphenylthio group, a 3-pentadecylphenylthio group, a 2-carboxyphenylthio group, and a 4-tetradecanamidophenylthio group, a heterocyclic thio group such as a 2-benzothiazolylthio group, an alkoxycarbonylamino group such as a methoxycarbonylamino group, and a tetradecyloxycarbonylamino group, an aryloxycarbonylamino group such as phenoxycarbonylamino group and a 2,4-di-tert-butylphenoxycarbonylamino group, a sulfonamido group such as a methanesulfonamido group, a hexadecanesulfonamido group, a benzenesulfonamido group, a p-toluenesulfonamido group, an octadecanesulfonamido group, and a 2-methyloxy-5-t-butylbenzenesulfonamido group, a carbamoyl group such as an N-ethylcarbamoyl group, an N,N-dibutylcarbamoyl group, an N-(2-dodecyloxyethyl)carbamoyl group, an N-methyl-N-dodecylcarbamoyl group, and an N-[3-(2,4-di-tert-amylphenoxy)propyl]carbamoyl group, an acyl group such as an acetyl group, a (2,4-di-tert-amylphenoxy)acetyl group, and a benzoyl group, a sulfamoyl group such as an N-ethylsulfamoyl group, an N,N-dipropylsulfamoyl group, an N-(2-dodecyloxyethyl)sulfamoyl group, an N-ethyl-N-dodecylsulfamoyl group, and an N,N-diethylsulfamoyl group, a sulfonyl group such as a methanesulfonyl group, an octanesulfonyl group, a benzenesulfonyl group, and a toluenesulfonyl group, a sulfinyl group such as an octanesulfinyl group, a dodecylsulfinyl group, and a phenylsulfinyl group, an alkoxycarbonyl group such as a methoxycarbonyl group, a butyloxycarbonyl group, a dodecyloxycarbonyl group, and an octadecyloxycarbonyl group, or an aryloxycarbonyl group such as a phenyloxycarbonyl group, and a 3-pentadecyloxycarbonyl group. X represents a hydrogen atom, a halogen atom such as chlorine, bromine and iodine, a carboxy group, a group having an oxygen linkage such as an acetoxy group, a propanoyloxy group, a benzoyloxy group, a 2,4-dichlorobenzoyloxy group, an ethoxyoxaloyloxy group, a pyruvoyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, and a 2-benzothiazolyloxy group, a group having a nitrogen linkage such as a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydrantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a-3,5-diethyl1,2,4-triazol-1-yl, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxyhydantoinyl group, and a 5-methyl-1-tetrazolyl group, an arylazo group such as 4-methoxyphenylazo group, a 4-pivaloylaminophenylazo group, a 2-naphthylazo group, and a 3-methyl-4-hydroxyphenylazo group, or a group having a sulfur linkage such as a phenylthio group, a 2-carboxyphenylthio group, a 2-alkoxyphenylthio group in which the phenyl moiety may be further substituted with an alkyl group preferably having 1 to 8 carbon atoms (e.g., 2-butoxyphenylthio group, 2-methoxy-5-t-octylphenylthio group, 2-butoxy-5-t-octylphenylthio group, 2-butoxy-5-butylphenylthio group, 2-methoxy-5-butylphenylthio group, etc.), a 4-methanesulfonylphenylthio group, a 4-octanesulfonamidophenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dedecylthio-5-thiophenylthio group, and a 2-phenyl-3-dodecyl-1,2,4-triazolyl-5-thio group.

The alkoxy group of the above-mentioned 2-alkoxyphenylthio group preferably has 1 to 12 carbon atoms. When the phenyl moiety of the 2-alkoxyphenylthio group is substituted with an alkyl group, the alkyl group preferably is attached to the 4- or 5-position, more preferably 5-position.

In the couplers of formulas (III) and (IV), $R^{12}$ and $R^{13}$ can together form a 5-, 6-, or 7-membered ring.

In the case where $R^{11}$, $R^{12}$, $R^{13}$, or X is a divalent group forming bis compound, $R^{11}$, $R^{12}$, and $R^{13}$ each represents an unsubstituted alkylene group having 1 to 16 carbon atoms or a substituted alkylene groups having about 10 to about 100 carbon atoms in total per pyrazoloazole ring such as a methylene group, an ethylene group, a 1,10-decylene group, and $—CH_2CH_2—O—CH_2CH_2—$, an unsubstituted phenylene group or a substituted phenylene group having about 6 to about 100 carbon atoms in total per pyrazoloazole ring, such as a 1,4-phenylene group) a 1,3-phenylene group,

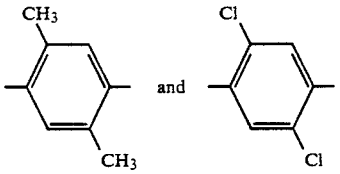

an $—NHCO—R^{14}—CONH—$ group in which $R^{14}$ represents an unsubstituted alkylene group having 1 to 16 carbon atoms or a substituted alkylene groups having about 10 to about 100 carbon atoms in total per pyrazoloazole ring or an unsubstituted phenylene group or a substituted phenylene group having about 6 to about 100 carbon atoms in total per pyrazoloazole ring, such as as $—NHCOCH_2CH_2CONH—$,

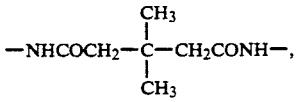

and

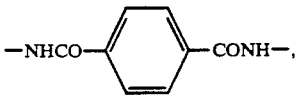

or an $—S—R^{14}—S—$ group in which $R^{14}$ represents an unsubstituted alkylene group having 1 to 16 carbon atoms or a substituted alkylene groups having about 10 to about 100 carbon atoms in total per pyrazoloazole ring, such as $—S—CH_2CH_2—S—$, and

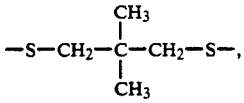

X represents a divalent group derived from one of the above monovalent groups represented by X and having another bond at proper portions.

In the case wherein the radicals derived from the formulae (III), (IV), (V), (VI), (VII), (VIII), and (IX) are contained in vinyl monomers as a moiety thereof, the linking groups represented by $R^{11}$, $R^{12}$, $R^{13}$, or X can include those comprising combinations of groups selected from an unsubstituted alkylene group having 1 to 16 carbon atoms or a substituted alkylene groups having about 10 to about 100 carbon atoms in total per pyrazoloazole ring, such as a methylene group, an ethylene group, a 1,10-decylene group, and $—CH_2CH_2OCH_2CH_2—$, an unsubstituted phenylene group or a substituted phenylene group having about 6 to about 100 carbon atoms in total per pyrazoloazole ring such as a 1,4-phenylene group, a 1,3-phenylene group,

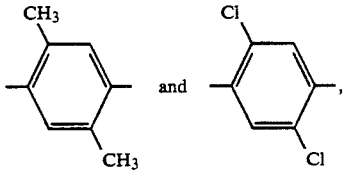

—NHCO—, —CONH, —O—, —OCO—, and an unsubstituted aralkylene group having about 8 to about 100 carbon atoms per pyrazoloazole ring or a substituted aralkylene group having about 8 to 100 carbon atoms per pyrazoloazole ring such as

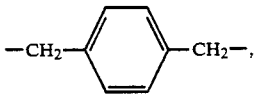

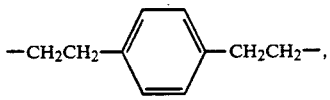

and

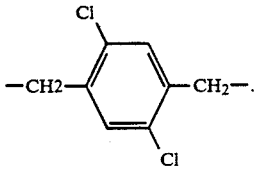

Preferred linkage groups include the following:

—NHCO—, $—CH_2CH_2—$,

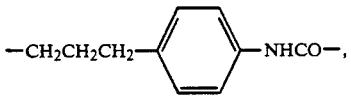

-continued

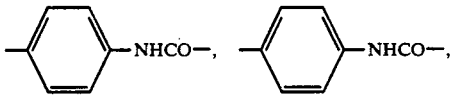

$-CH_2CH_2NHCO-$, $-CH_2CH_2-O-\underset{\underset{O}{\|}}{C}-$, $-CONH-CH_2CH_2NHCO-$, $-CH_2CH_2O-CH_2CH_2-NHCO-$, and

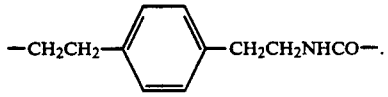

The vinyl monomers may comprise substituent groups other than those derived from the compounds represented by formulae (III), (IV), (V), (VI), (VII), (VIII) and (IX). Preferred substituent groups include a hydrogen atom, a chlorine atom, and lower alkyl groups having from 1 to 4 carbon atoms, such as a methyl group and an ethyl group.

The monomers comprising the substituent groups represented by radicals derived from formulae (III), (IV), (V), (VI), (VII), (VIII), and (IX) may form a copolymer with a non-coloring ethylenic monomer which does not undergo coupling with an oxide of an aromatic primary amine developing agent.

Example of such non-coloring ethylenic monomers which do not undergo coupling with an oxide of an aromatic primary amine developing agent include acrylic acid; α-chloroacrylic acid; α-alkylacrylic acids such as methacrylic acid and esters or amides derived therefrom, such as acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylexyl acrylate, n-octyl acrylate, lauryl acrylate, methyl methacrylate, ethyl methacrylate, n-butyl methacrylate, and β-hydroxyethyl methacrylate; methylenebisacrylamide; vinyl esters such as vinyl acetate, vinyl propionate, and vinyl laurate; acrylonitrile; methacrylonitrile; aromatic vinyl compounds such as styrene and derivatives thereof; vinyl toluene; divinyl benzene; vinyl acetophenone; and sulfostyrene, itaconic acid, citraconic acid, crotonic acid, vinylidene chloride, vinylalkyl ethers such as vinyl ethyl ether; maleic acid, maleic anhydride; N-vinyl-2-pyrrolidone; N-vinyl pyridine; and 2- and 4-vinyl pyridine. These non-coloring ethylenic unsaturated monomers may be used in combinations thereof, such as n-butyl acrylate and methyl acrylate, styrene and methacrylic acid, methacrylic acid and acrylamide, and methyl acrylate and diacetoneacrylamide.

As is well known in the field of polymer color couplers, non-coloring ethylenic unsaturated monomers to be copolymerized with solid water-insoluble monomer couplers can properly be selected so that the physical and/or chemical properties of the copolymers thus formed such as solubility, compatibility with a binder in photographic colloid composition such as gelatin, flexibility, and thermal stability can be favorably affected thereby.

The polymer couplers used in the present invention may be either water-soluble or water-insoluble. Polymeric coupler latexes are preferred.

Specific examples and synthesis of the pyrazoloazole magenta coupler of formula (II) to be used in the present invention are described in Japanese Patent Application (OPI) Nos. 162548/84, 43659/85, 171956/84, 172982/85 and 33552/85, and U.S. Pat. No. 3,061,432.

Specific examples of typical magenta couplers of the present invention and vinyl monomers thereof are shown below. However, the present invention is not limited to these compounds.

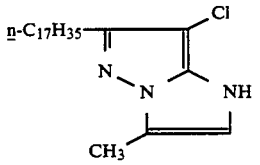

(M-1)

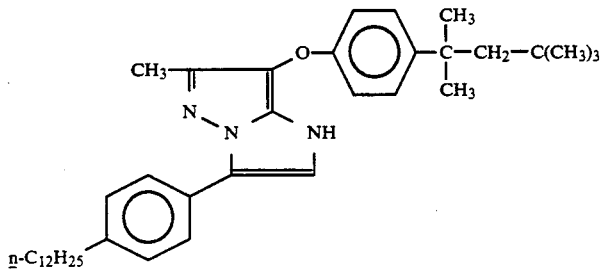

(M-2)

-continued
(M-3)
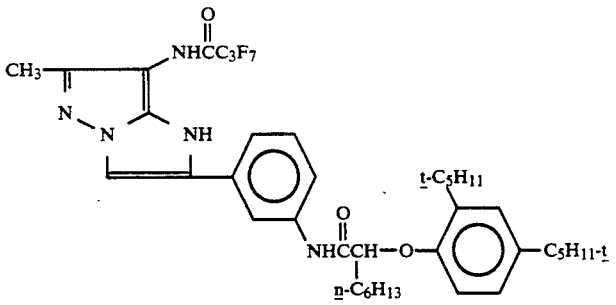
(M-4)
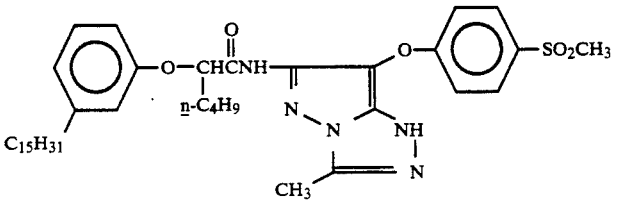
(M-5)
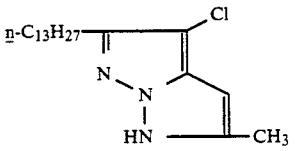
(M-6)
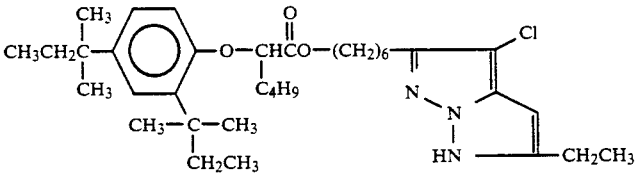
(M-7)
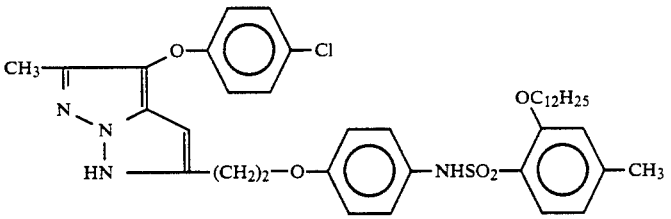
(M-8)
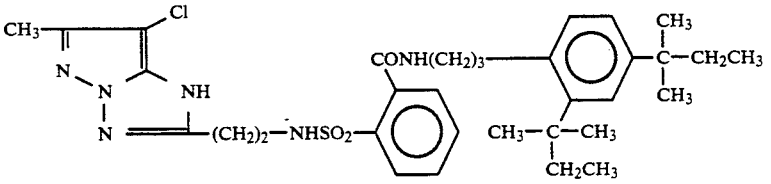
(M-9)
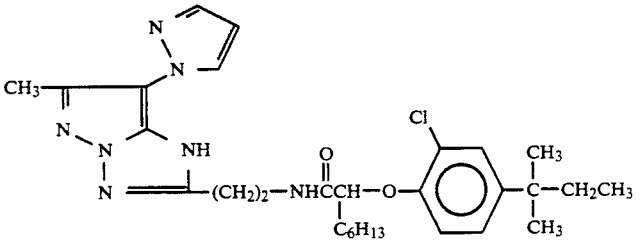

-continued
(M-10)
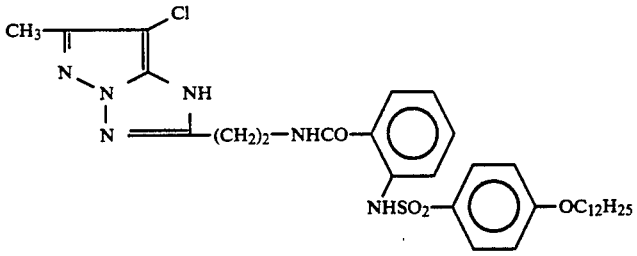
(M-11)
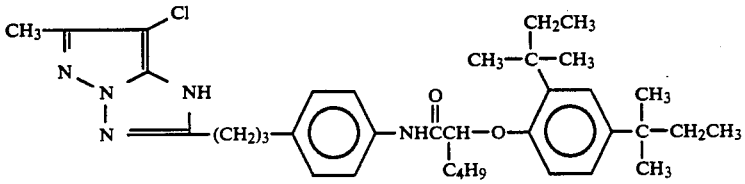
(M-12)
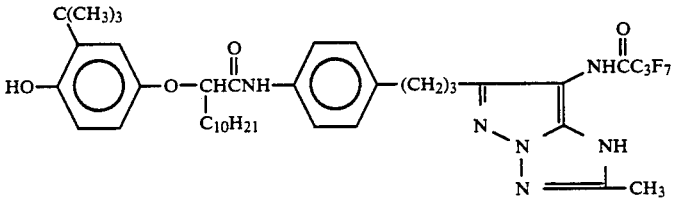
(M-13)
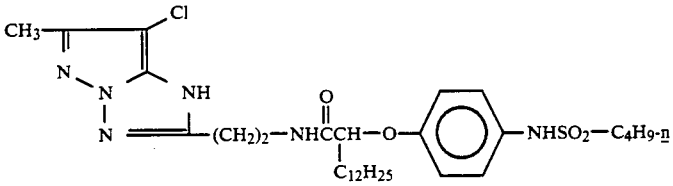
(M-14)
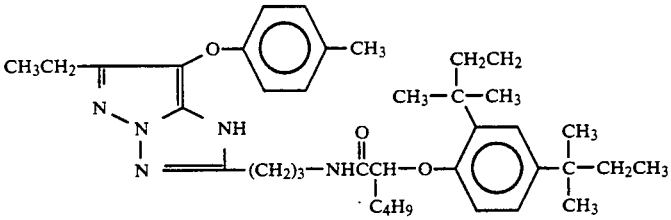
(M-15)
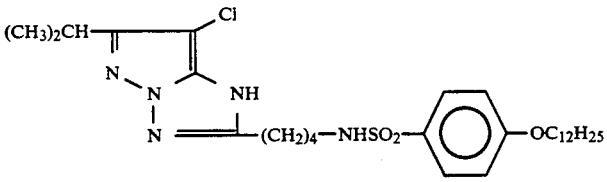
(M-16)
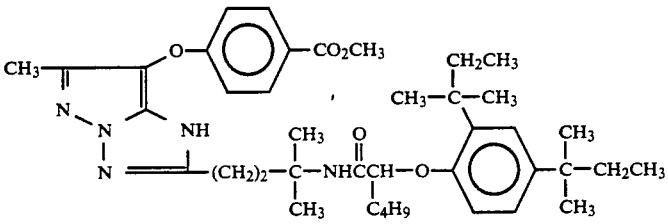

-continued
(M-17)
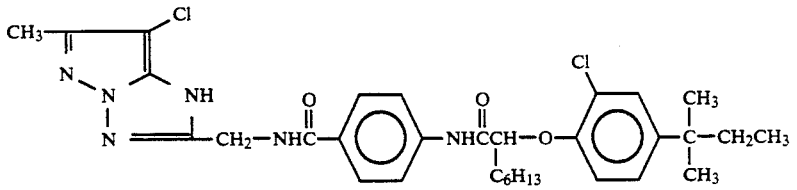
(M-18)
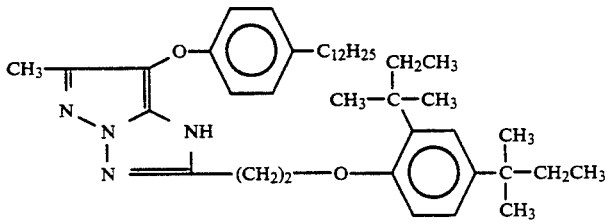
(M-19)
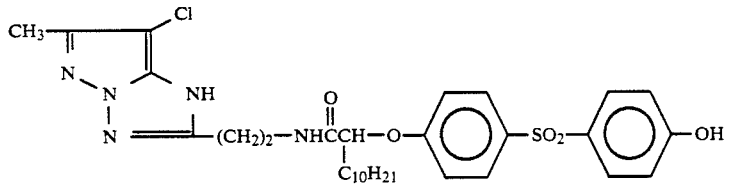
(M-20)
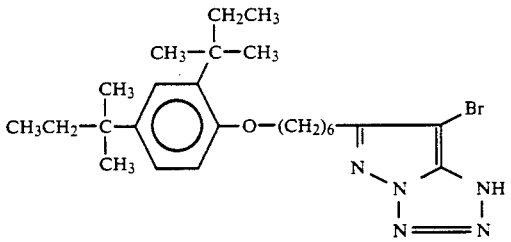
(M-21)
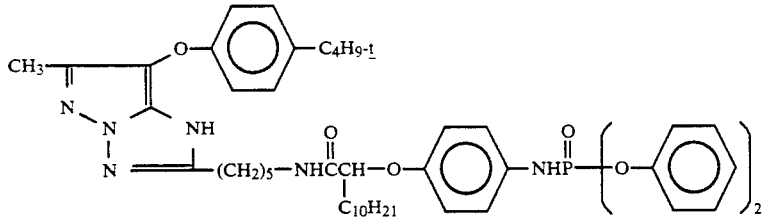
(M-22)
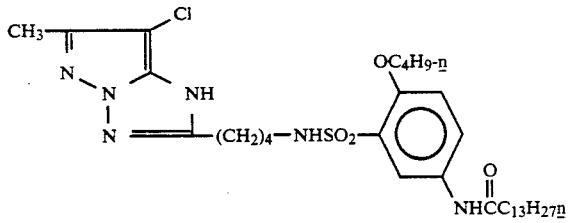
(M-23)
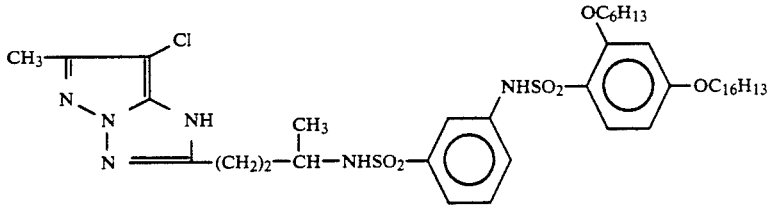

-continued
(M-24)
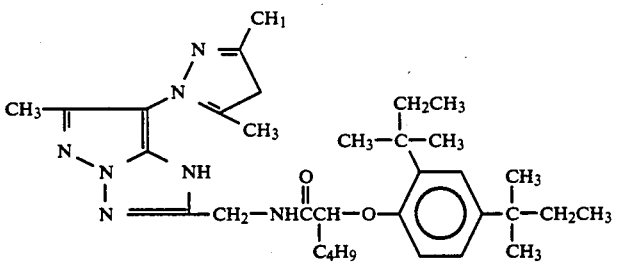
(M-25)
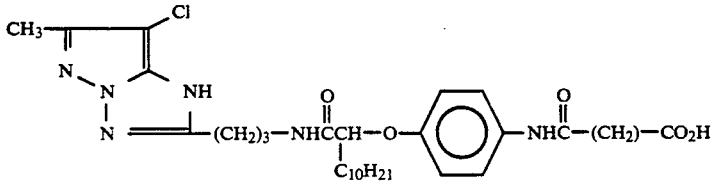
(M-26)
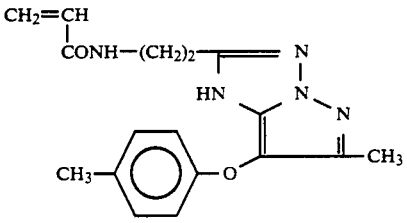
(M-27)
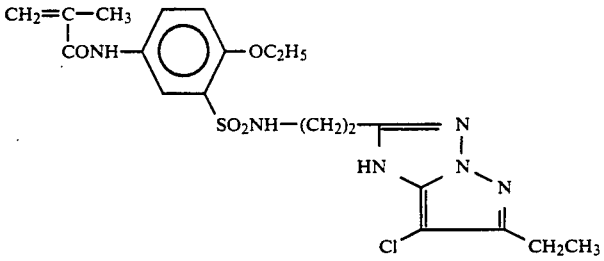
(M-28)
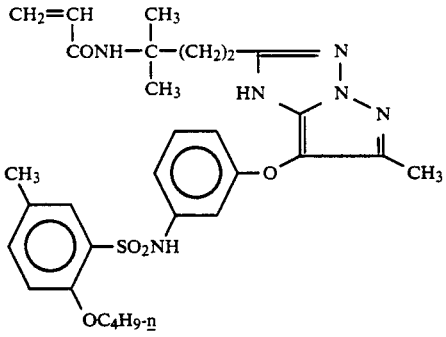
(M-29)
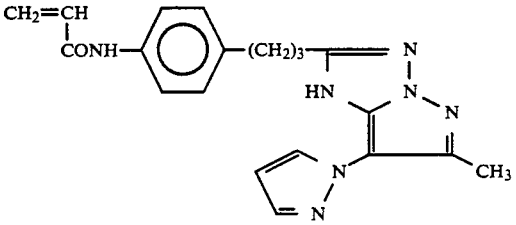

-continued
(M-30)
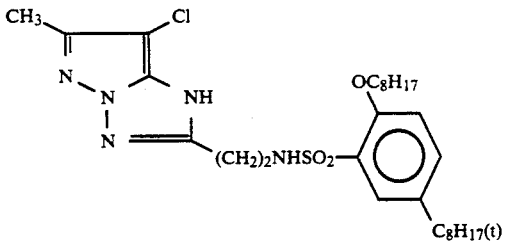
(M-31)
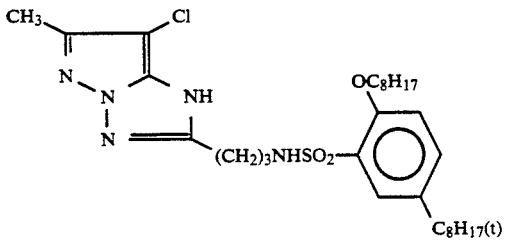
(M-32)
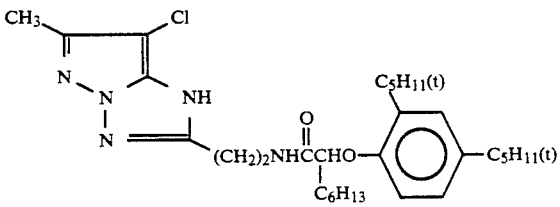
(M-33)
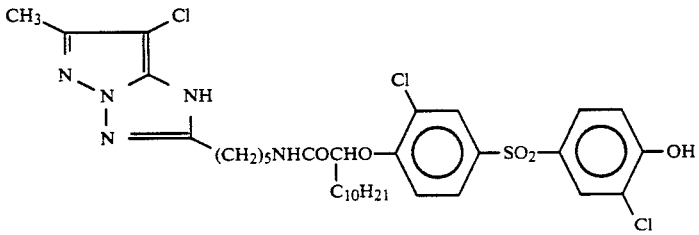
(M-34)
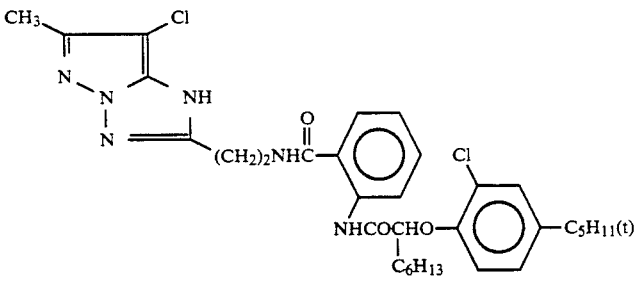
(M-35)
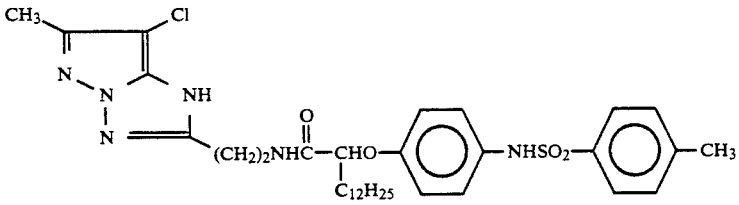
(M-36)
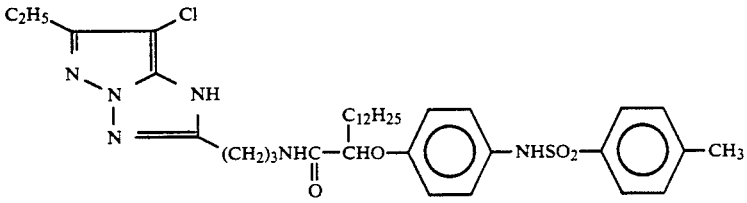

-continued
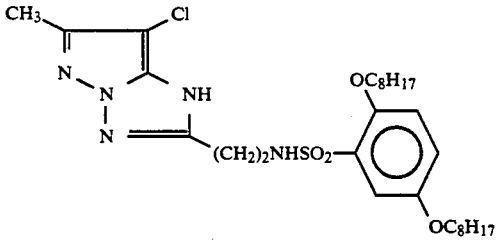
(M-37)
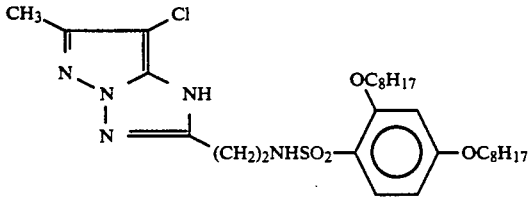
(M-38)
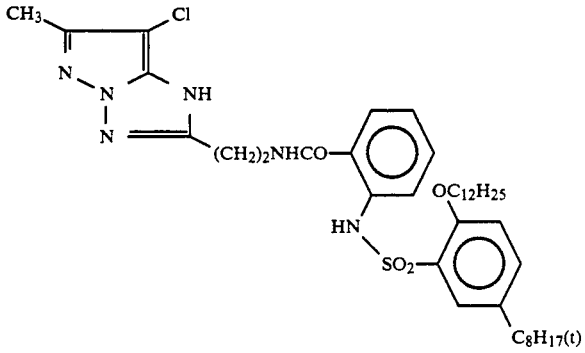
(M-39)
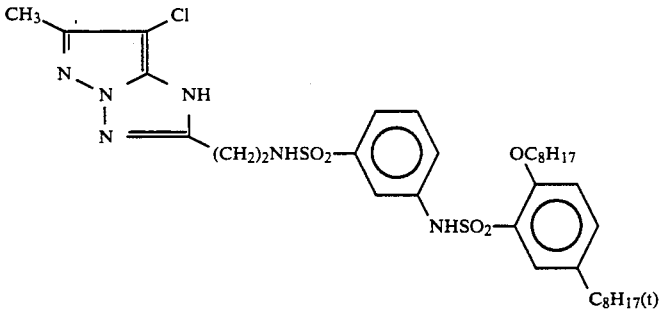
(M-40)
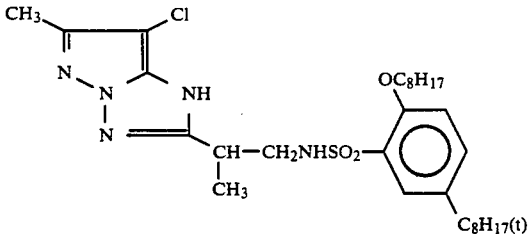
(M-41)
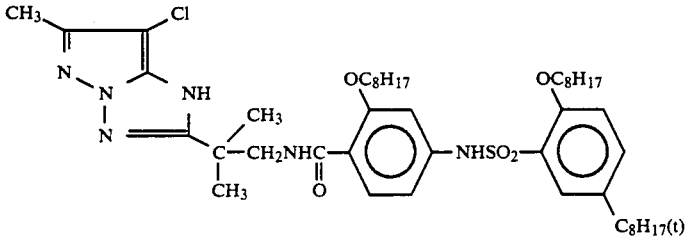
(M-42)

-continued
(M-43)
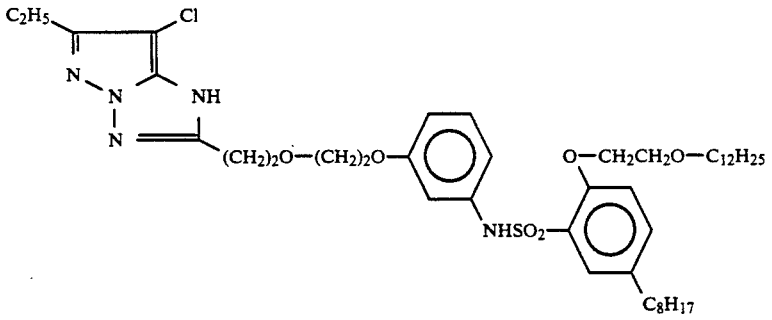
(M-44)
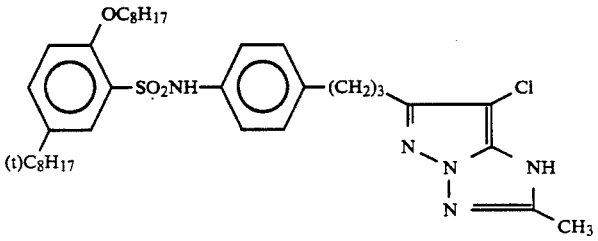
(M-45)
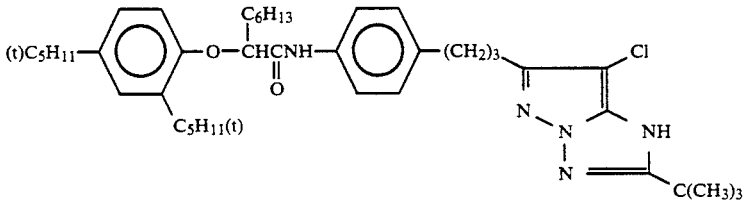
(M-46)
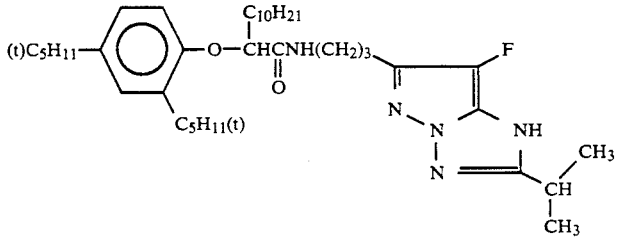
(M-47)
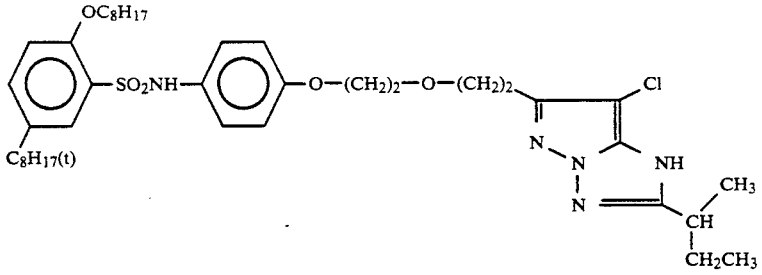
(M-48)
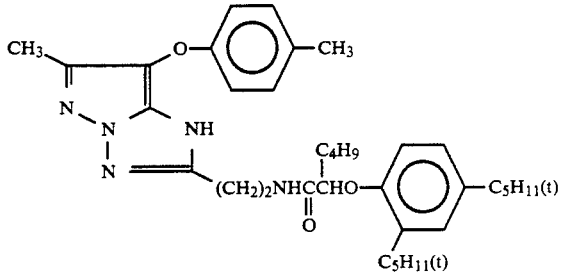

-continued
(M-49)
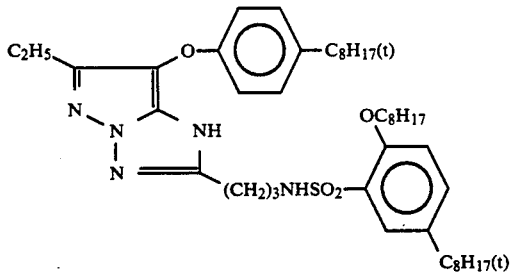
(M-50)
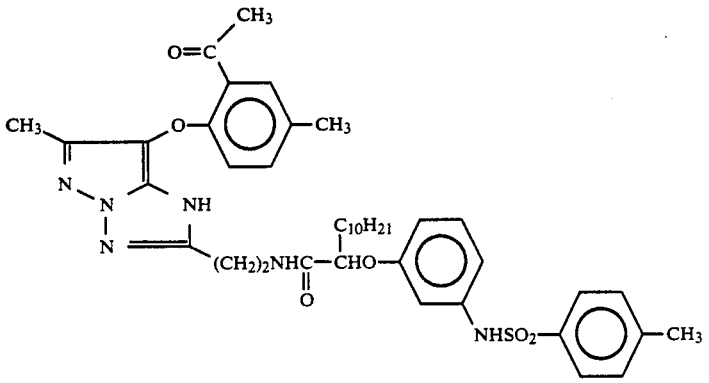
(M-51)
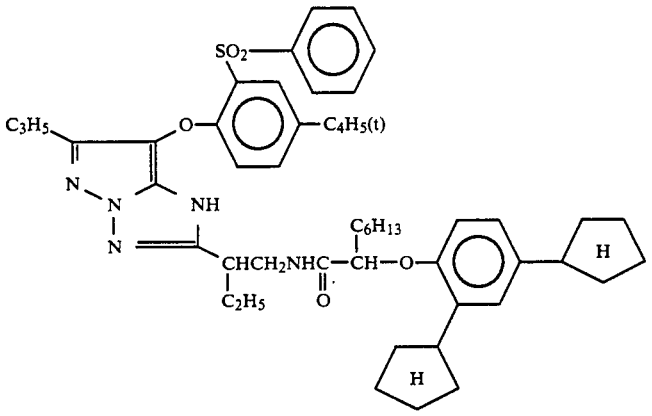
(M-52)
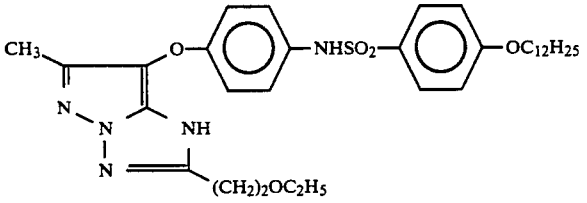
(M-53)
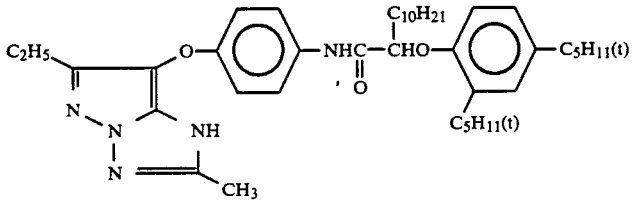

-continued
(M-54)
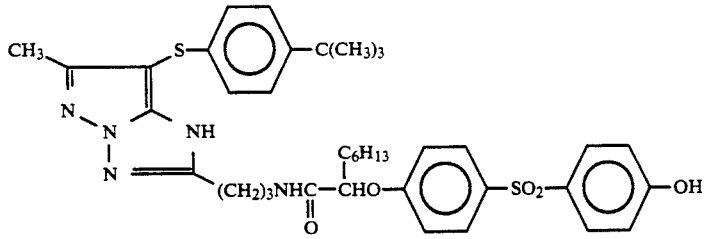
(M-55)
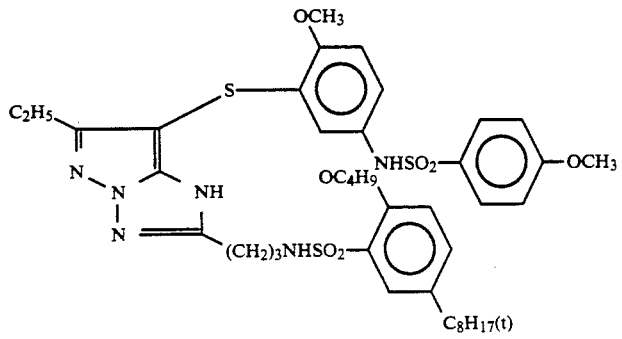
(M-56)
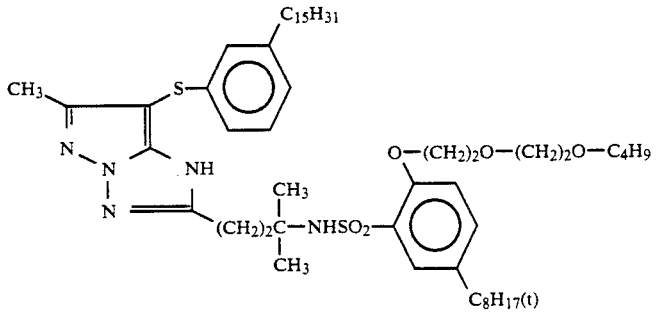
(M-57)
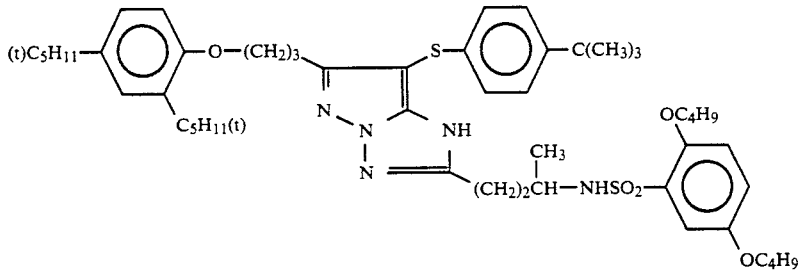
(M-58)
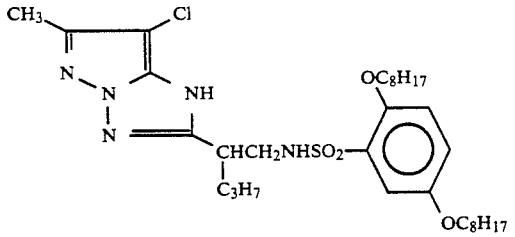
(M-59)
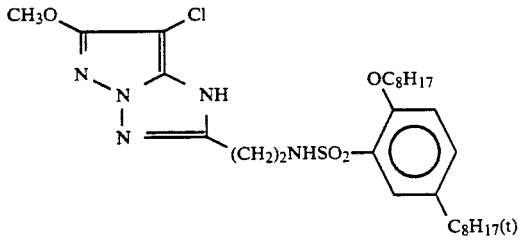

-continued
(M-60)
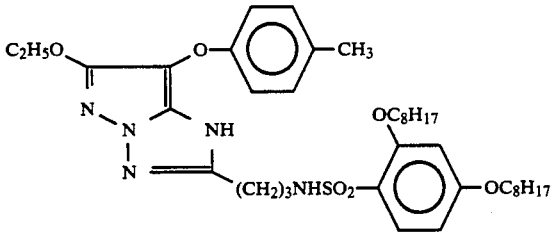
(M-61)
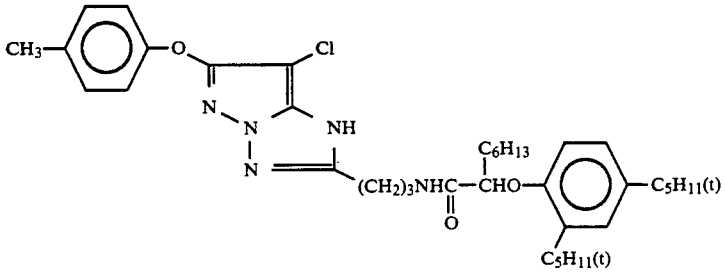
(M-62)
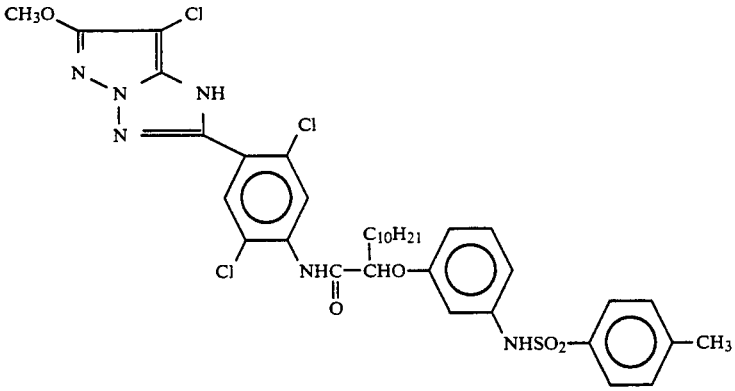
(M-63)
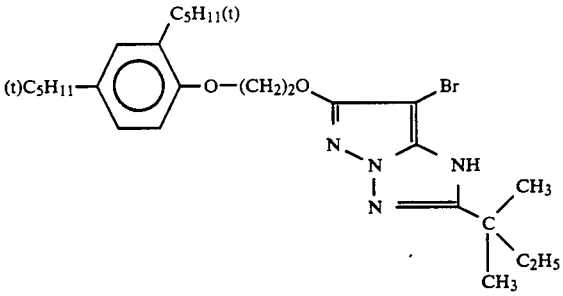
(M-64)
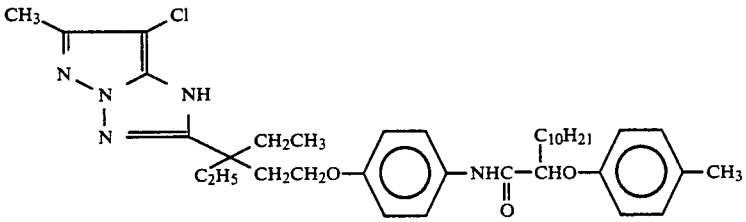

-continued
(M-65)
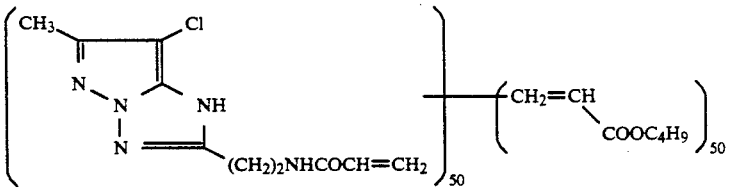
(M-66)
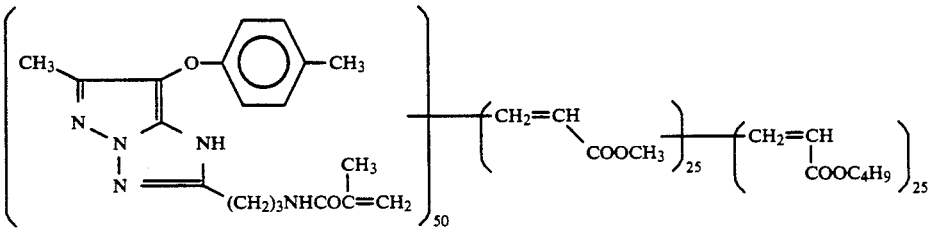
(M-67)
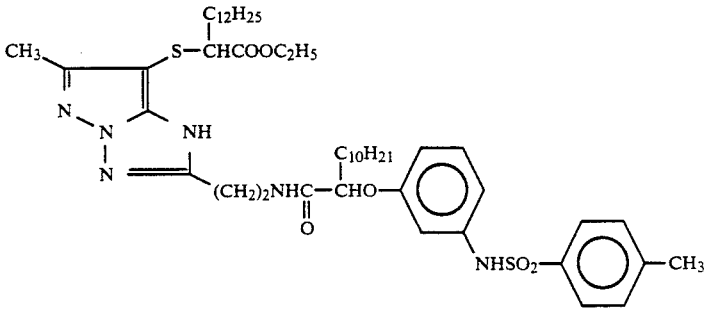
(M-68)
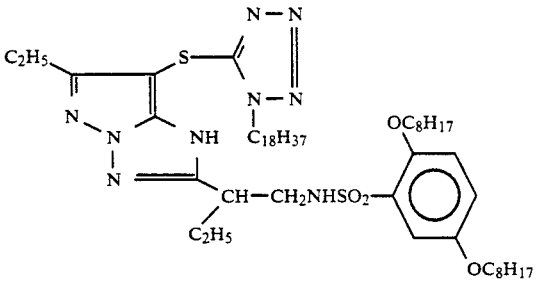
(M-69)
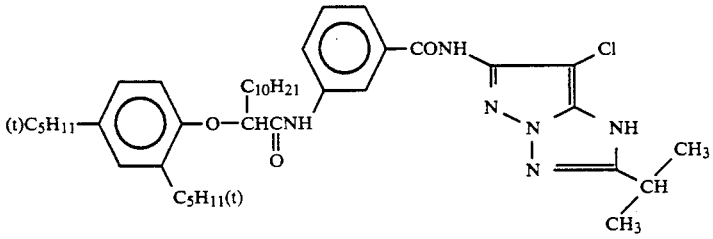
(M-70)
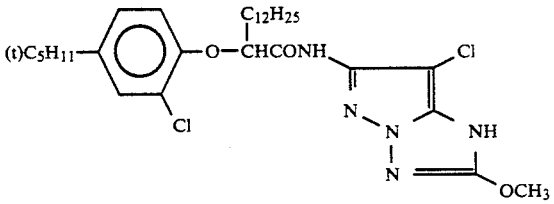

-continued
(M-71)
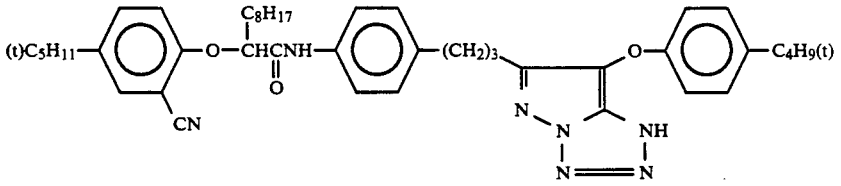
(M-72)
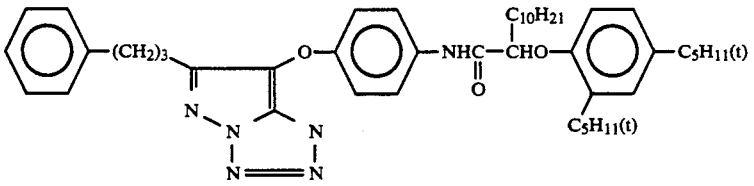
(M-73)
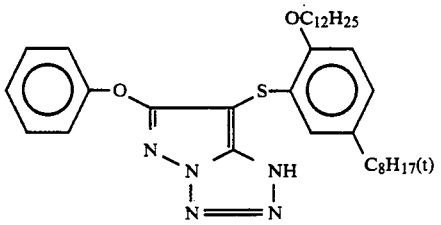
(M-74)
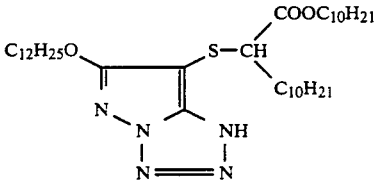
(M-75)
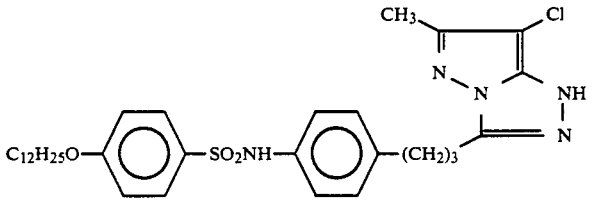
(M-76)
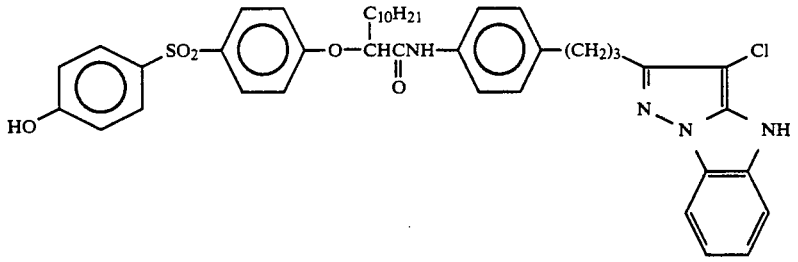
(M-77)
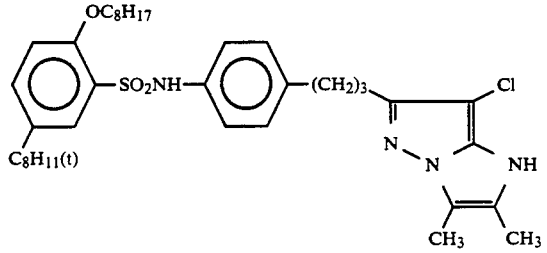

-continued
(M-78)
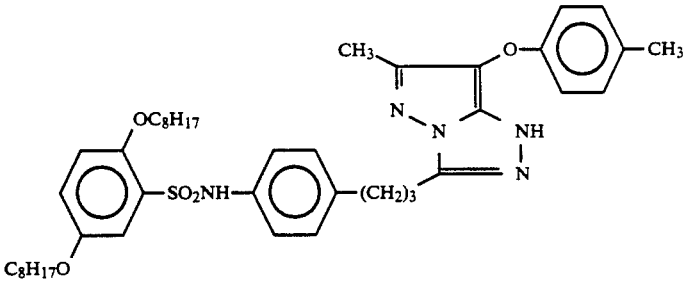
(M-79)
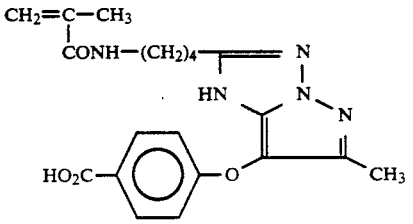
(M-80)
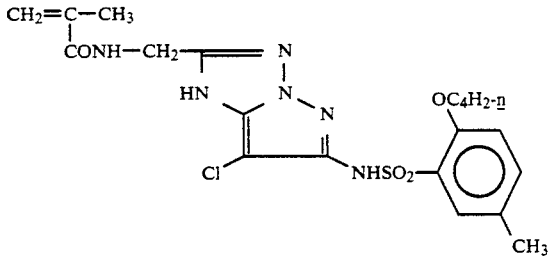
(M-81)
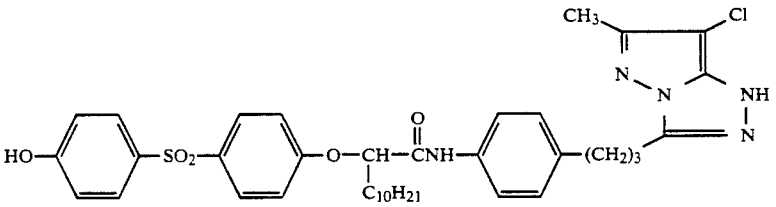
(M-82)
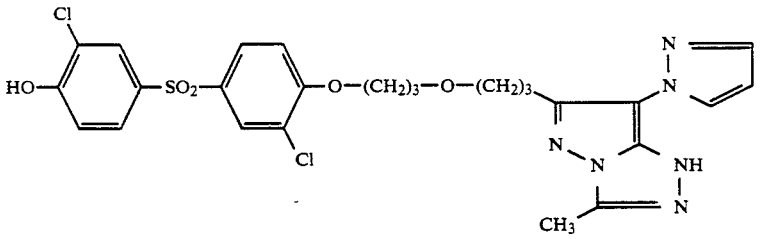
(M-83)
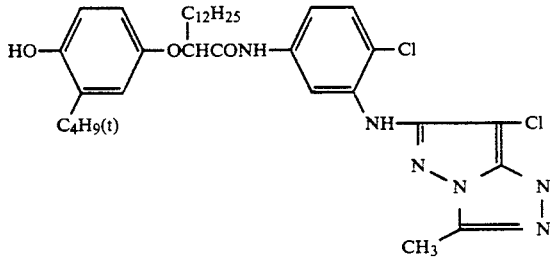

-continued
(M-84)
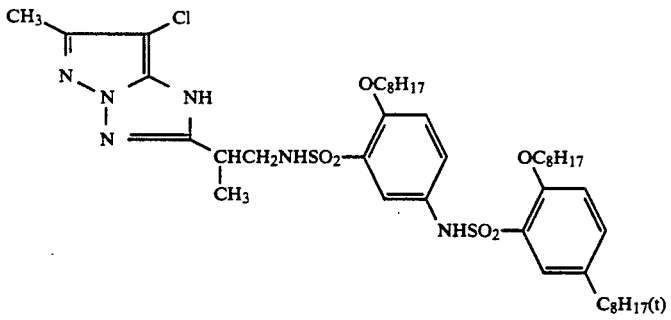
(M-85)
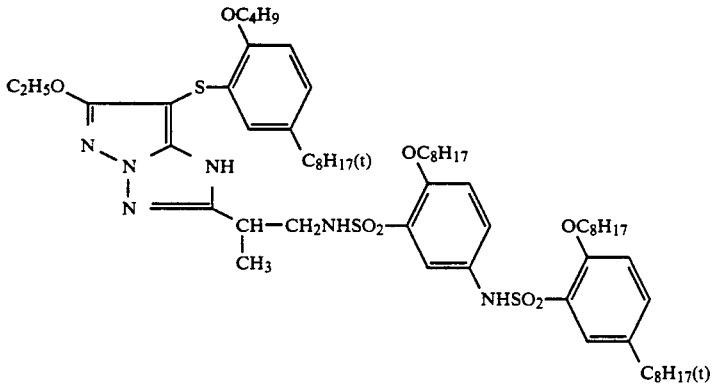
(M-86)
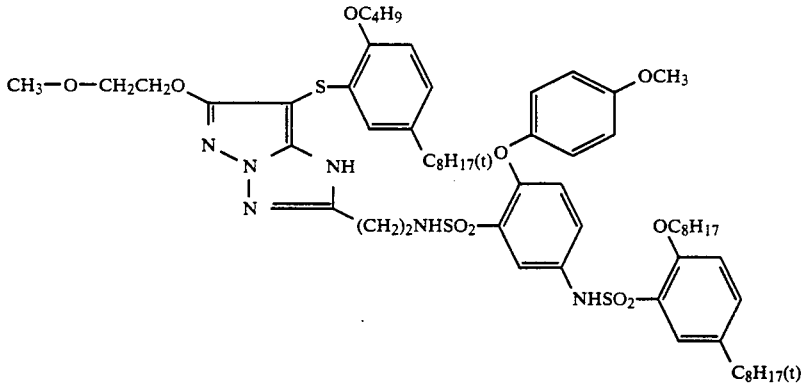
(M-87)
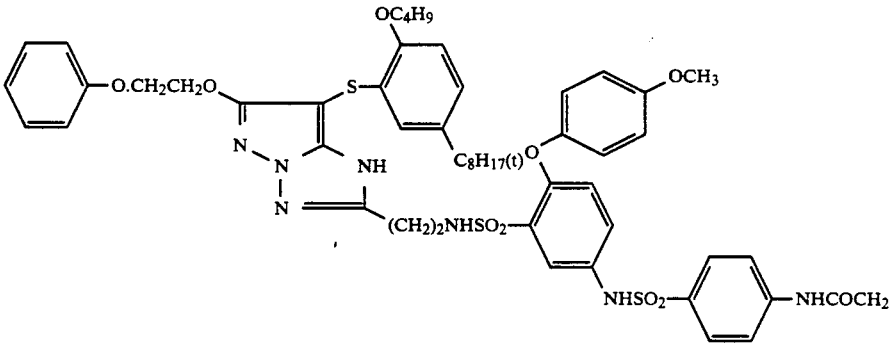

-continued
(M-88)
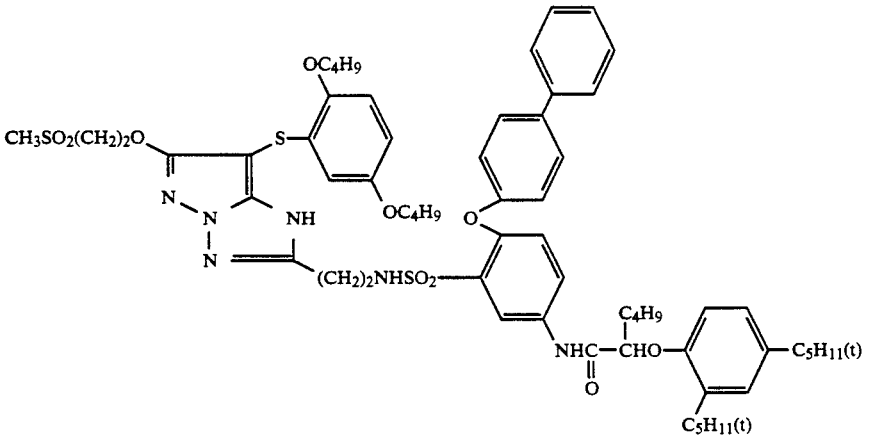
(M-89)
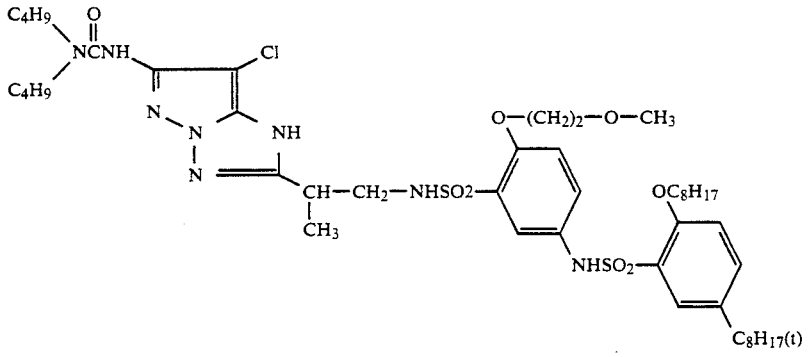
(M-90)
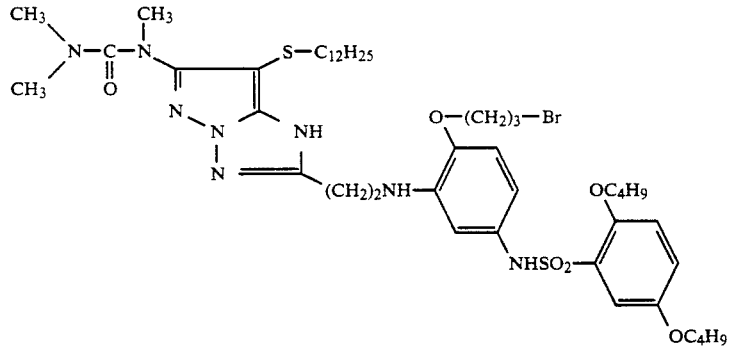
(M-91)
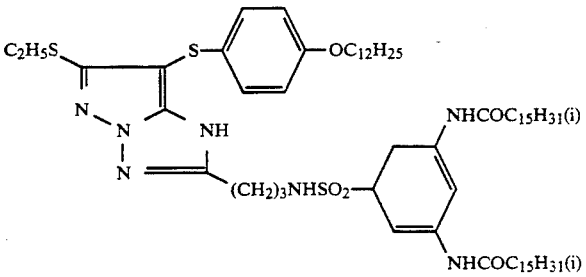

-continued
(M-92)
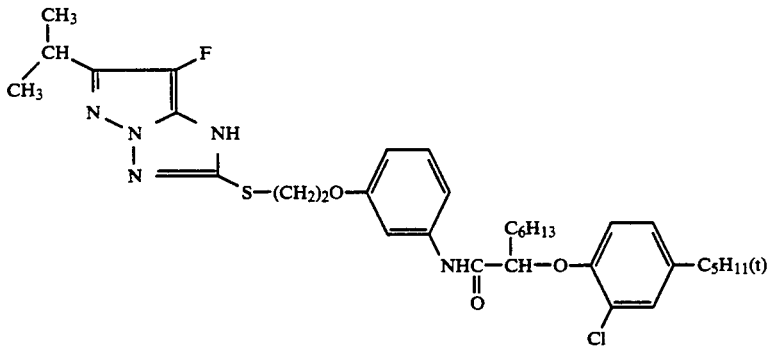
(M-93)
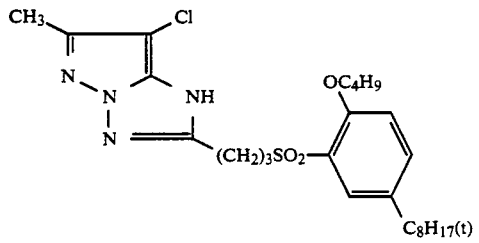
(M-94)
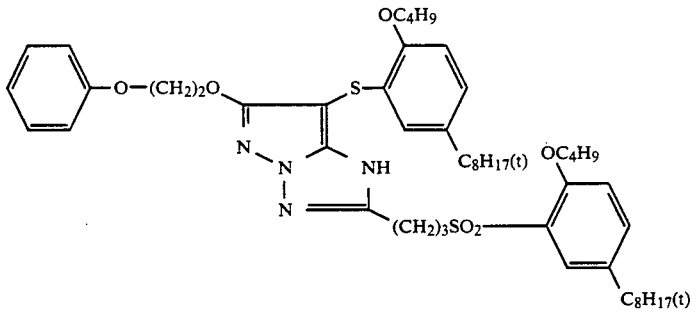
(M-95)
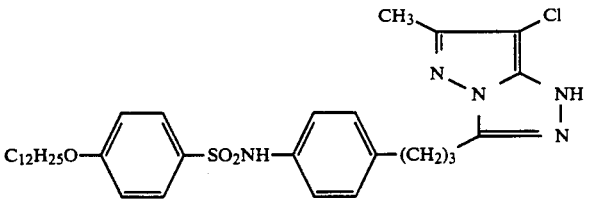
(M-96)
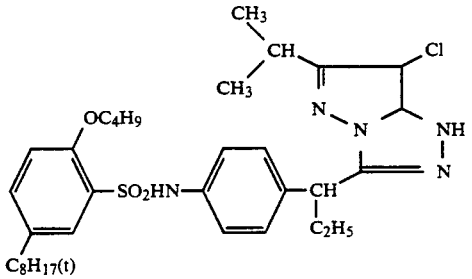

-continued
(M-97)
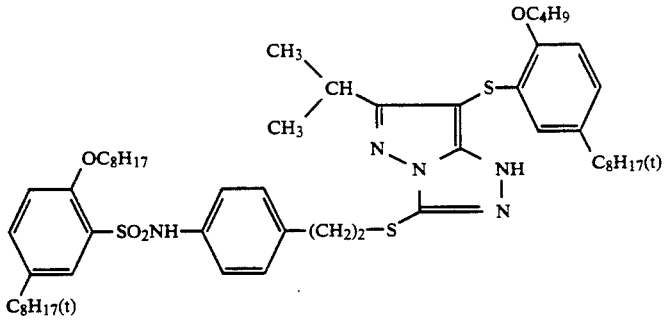
(M-98)
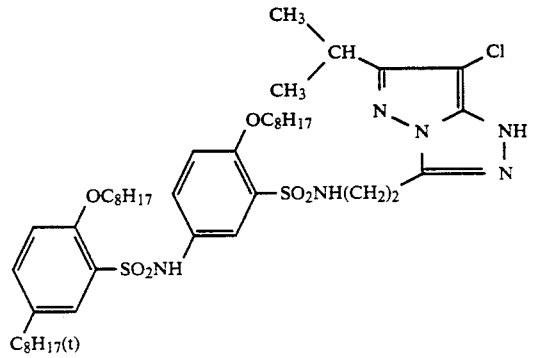
(M-99)
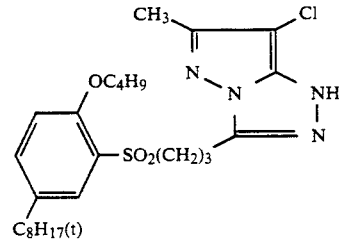
(M-100)
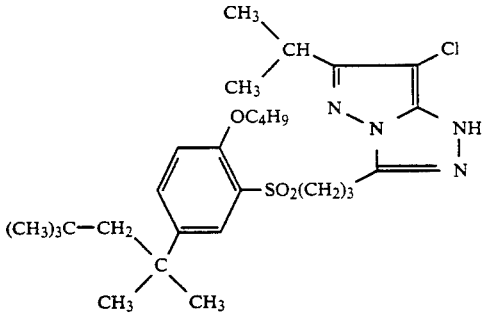
(M-101)
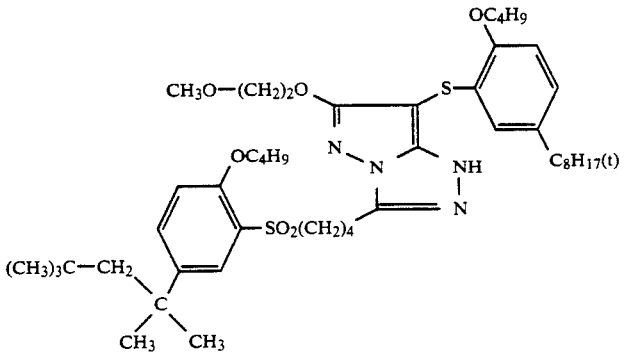

-continued

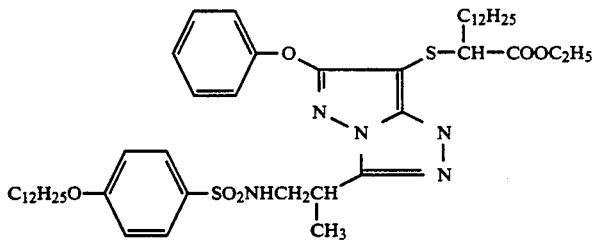

(M-102)

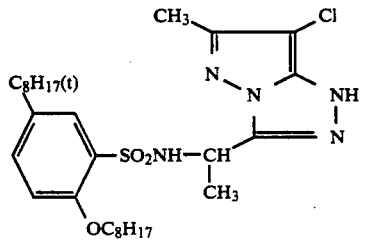

(M-103)

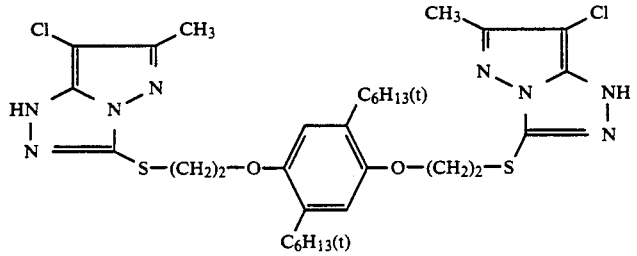

(M-104)

Specific examples of high boiling point organic solvents suitable to dissolve magenta couplers to be used in the present invention include phthalic ethers such as dibutyl phthalate, dicyclohexyl phthalate, di-2-ethylhexyl phthalate, and decyl phthalate, phosphoric or phosphonic esters such as triphenyl phosphate, tricresyl phosphate, 2-ethylhexyl diphenyl phosphate, tricylcohexyl phosphate, tri-2-ethylhexyl phosphate, tridodecyl phosphate, tributoxyethyl phosphate, trichloropropyl phosphate, and di-2-ethylhexyl phenyl phosphate, benzoates such as 2-ethylhexyl benzoate, dodecyl benzoate, and 2-ethylhexyl p-hydroxybenzoate, amides such as diethyldodecanamide and N-tetradecylpyrrolidone, alcohols or phenols such as isostearyl alcohol and 2,4-di-tert-amylphenol, aliphatic carboxylic esters such as dioctyl azelate, glycerol tributyrate, isostearyl lactate, and trioctyl citrate, aniline derivatives such as N,N-dibutyl-2-butoxy-5-tert-octylaniline, and hydrocarbons such as paraffin, dodecylbenzene and diisopropylnaphthalene. As auxiliary solvents organic solvents having a boiling point in the range of from about 30° to 160° C. and preferably from 50° to 160° C., may be used. Typical examples of such organic solvents include ethyl acetate, butyl acetate, ethyl propionate, methyl ethyl ketone, cyclohexanone, 2-ethoxyethyl acetate, and dimethylformamide.

The photographic material of the present invention may be used in combination with various color couplers. The term "color coupler" as used herein means a compound which undergoes coupling reaction with an oxide of an aromatic primary amine developing agent to form a dye. Useful color couplers include couplers which develop cyan, magenta, and yellow dyes. Typical examples of such color couplers include naphtholic or phenolic compounds, pyrazolone or pyrazoloazole compounds, and open-ring or heterocyclic ketomethylene compounds. Specific examples of these cyan, magenta, and yellow couplers are described, e.g., in the patents cited in *Research Disclosure RD* No. 17643 (December 1978) (Article VII-D), and *Research Disclosure,* RD No. 18717 (November 1979).

The color couplers to be incorporated into the photographic material of the present invention are preferably diffusion-resistant by means of ballast groups or by being polymerized. The amount of silver to be coated can be reduced and a higher sensitivity can be obtained by using a 2-equivalent color coupler which comprises the coupling active position substituted by a releasing group, rather than by using a 4-equivalent color coupler which comprises a hydrogen atom at the coupling active position. Other coloring dyes which may be used in the present invention include couplers comprising a dye having a proper diffusion property, non-coloring couplers, DIR couplers which release a development inhibitor upon coupling, and couplers which release a development accelerator upon coupling.

Typical yellow couplers which may be used in the present invention include oil protect type acylacetoamide couplers. Specific examples of such couplers include those described in U.S. Pat. Nos. 2,407,210, 2,875,057, and 3,256,506. In the present invention, 2-equivalent yellow couplers are preferably used. Typical examples of such 2-equivalent yellow couplers include α-pivaloylacetanilide coupler having a nitrogen atom or oxygen atom-containing releasing group wherein the nitrogen or oxygen atom is attached to the coupling position described in U.S. Pat. Nos. 3,408,194, 3,447,928, 3,933,501, 4,022,620, 4,401,752 and 4,326,024, Japanese Patent Publication No. 10739/83, *Research Disclosure,* RD No. 18053 (April 1979), British Patent 1,425,020, West German Patent Application (OLS)

Nos. 2,219,917, 2,261,361, 2,329,587, and 2,433,812. α-Pivaloylacetoanilide couplers are excellent in fastness of the developed dye, especially to light. On the other hand, α-benzoylacetoanilide couplers provide a high color density.

Typical cyan couplers which may be used in the present invention include phenol-type couplers in which at least the 2-position is substituted with an acylamino group, and the 5-position is substituted with an alkyl group having 2 or more carbon atoms, e.g., an ethyl group or an acylamino group described in U.S. Pat. Nos. 3,772,002, 2,772,162, 3,758,308, 4,126,396, 4,334,011, and 4,327,173, West German Patent Application (OLS) No. 3,329,729, and European Patent 121,365.

A typical amount of the color coupler of the present invention to be used is from 0.001 to 1 mol per mol of light-sensitive silver halide. Preferably, the amount of yellow coupler to be used is from 0.01 to 0.5 mol per mol of light-sensitive silver halide. The amount of magenta coupler to be used is from 0.003 to 0.3 mol per mol of light-sensitive silver halide. The amount of cyan coupler to be used is from 0.002 to 0.3 mol per mol of light-sensitive silver halide. Typical amount of yellow, magenta and cyan couplers to be coated on a color paper are from $4\times10^{-4}$ to $14\times10^{-4}$, from $2\times10^{-4}$ to $8\times10^{-4}$, and from $2\times10^{-4}$ to $9\times10^{-4}$ mol/m$^2$, respectively.

The photographic emulsion employed in accordance with the present invention can be prepared by the methods described, for example, in P. Glafkides; *Chimie et Physique Photographique* (Paul Montel, 1966); and V. L. Zelikman et al, *Making and Coating Photographic Emulsion* (The Focal Press, 1964). Thus, any of the acid method, neutral method, ammonia method, etc., can be utilized, and as the method comprising reacting a soluble silver salt with a soluble halogen salt, any of a single-jet method, a double-jet method, or a combination thereof may be employed.

The method in which grains are formed in the presence of an excess of silver ion (the so-called reverse-jet method) may also be employed. As a mode of double-jet addition, one may employ a controlled double-jet method, herein the pAg in the liquid phase wherein silver halide is formed is kept constant.

Of these methods, particularly the method of preparing photographic emulsion using mainly the double-jet method or controlled double jet method readily yields a silver halide emulsion in which the silver halide grains are regular in shape.

Furthermore, there can also be employed a silver halide emulsion prepared by a conversion method in which silver halide grains already formed are converted into those having a smaller solubility product during the period between the step of preparing silver halide grains and the step of chemical sensitizing, and a silver halide emulsion prepared by subjecting silver halide grains after completion of formation thereof to a halogen conversion method similar to the above conversion method.

Silver halide emulsions are usually physically ripened after formation of silver halide grains, removed of salts and chemically ripened before coating.

During the precipitation, physical ripening or chemical ripening of silver halide grains, known silver halide solvents can be used suitable examples of which include ammonia, potassium thiocyanate, and thioether compounds and thione compounds as described in U.S. Pat. No. 3,271,157 and Japanese Patent Application (OPI) Nos. 12360/76, 82408/78, 144319/78, 100717/79 and 155828/79.

In order to remove soluble silver salts from the emulsion after physical ripening, a Nudel water washing method, a flocculation precipitation method, an ultrafiltration and so forth can be employed.

In the process of formation or physical aging of silver halide grains to be used in the present invention, cadmium salt, zinc salt, lead salt, thallium salt, iridium salt or complex salt thereof, rhodium salt or complex salt thereof, or iron salt or complex salt thereof can be used. In particular, iridium salt is preferably used. The silver halide emulsion to be used in the present invention may optionally not be chemically sensitized (after-aged), but generally is chemically sensitized. The chemical sensitization can be effected by the known methods.

Specifically, sulfur sensitization process using a sulfur-containing compound capable of reacting with active gelatin and silver such as thiosulfate, thiourea, mercapto compound, and rhodanine, reduction sensitization process using a reducing material such as stannous salt, amine, hydrazine derivative, formamidinesulfinic acid, and silane compound, and noble metal sensitization process using a noble metal compound such as gold compound and complex salt of the group VIII metals such as platinum, iridium, and palladium may be used singly or in combination thereof. Of these methods, the sulfur sensitization method is preferred.

In order to obtain a satisfactory gradation the silver halide color photographic material of the present invention may comprise in a silver halide emulsion layer having substantially the same color sensitivity two or more monodisperse silver halide emulsions (preferably having the above-described coefficient of variation of size of silver halide grains) in admixture in the same layer or superimposed as different unit layers. Further, two or more polydisperse silver halide emulsions or a combination of monodisperse silver halide emulsion and polydisperse silver halide emulsion can be used in admixture or superimposition.

The photographic emulsion to be used in the present invention may contain various compounds for the purpose of prevention of fog during production, storage and photographic treatment of light-sensitive material or stabilization of photographic properties. Examples of such compounds which may be added to the photographic material of the present invention include those known as fog inhibitors or stabilizers. Such fog inhibitors or stabilizers include azoles such as benzothiazolium salts, nitroimidazoles, nitrobenzimidazoles, chlorobenzimidazoles, bromobenzimidazoles, nitroindazoles, benzotriazoles, and aminotriazoles, mercapto compounds such as mercaptothiazoles, mercaptobenzothiazoles, mercaptobenzimidazoles, mercptothiadiazoles, mercaptotetrazoles (e.g., 1-phenyl-5-mercaptotetrazole), mercaptopyrimidines, and mercaptotriazines, thiketo compounds such as oxazolinethione, azaindenes such as triazaindenes, tetraazaindenes (e.g., 4-hydroxy-substituted (1,3,3a,7)-tetraazaindene, and pentaazaindenes, benzenethiosulfonic acid, benzenesulfinic acid, and benzensulfuonic amide.

Such compounds and use thereof are described in detail in U.S. Pat. Nos. 3,954,474 and 3,982,947, and Japanese Patent Publication No. 28660/77.

Spectral sensitizes, supersensitizers, light absorbers, filter dyes, light reflectors, hardeners, plasticizers, lubricants, coating aids (surface active agents), anti-static agents, and other additives, and material such as binder to be used in the silver halide emulsion and other hydrophilic colloid layers of the present invention, and supports and treatment processes which can be used in the color photographic material of the present invention are described, for example, in *Research Disclosure,* RD No. 17643, pp. 22–29 (December 1978), and RD No. 18716, pp. 647–651 (November 1979).

Color fog inhibitors, discoloration inhibitors, agents for inhibiting deterioration due to light, heat and moisture, and ultraviolet absorbers suitable for magenta dye images which may be used in the present invention are hereinafter described.

Such fog inhibitors or stabilizers and use thereof are further illustrated, for example, in U.S. Pat. Nos. 3,954,474 and 3,982,947, Japanese Patent Publication No. 28660/77, RD No. 17643 (December 1978) (VI A-VI M), and *Stabilization of Photographic Silver Halide Emulsions,* by E. J. Barl, Ed., published by Focal Press, 1974.

Color fog inhibitors or discoloration inhibitors that may be used include hydroquionne derivatives, aminophenol derivatives, amines, gallic acid derivatives, catechol derivatives, ascorbic acid derivatives, colorless couplers, and sulfonamido phenol derivatives.

The photographic material of the present invention may comprise various discoloration inhibitors. Typical examples of organic discoloration inhibitors include hydroquinones, 6-hydroxychromans, 5-hydroxycoumaranes, spirochroman, p-alkoxyphenols, hindered phenols mainly comprising bis-phenols, gallic acid derivatives, methylenedioxybenzenes, aminophenols, hindered amines and products of silylation or alkylation of phenolic hydroxyl groups thereof or ester derivatives thereof. In addition, metal complexes such as (bis-salicylaldoximate) nickel complex and (bis-N,N-dialkyl dithiocarbamate) nickel complex may be used.

Specific examples of such as organic discoloration inhibitors are described in many patents. In particular, examples of hydroquinones are described in U.S. Pat. Nos. 2,360,290, 2,418,613, 2,700,453, 2,701,197, 2,728,659, 2,732,300, 2,735,765, 3,982,944, 4,430,425, 2,710,801 and 2,816,028,and British Patent 1,363,921. Examples of 6-hydroxy chromans and spiro chromans are described in U.S. Pat. Nos. 3,432,300, 3,573,050, 3,574,627, 3,698,909, and 3,764,337, and Japanese Patent Application (OPI) No. 152225/77. Examples of spiroindanes are described in U.S. Pat. No. 4,360,589. Examples of spiroindanes are described in U.S. Pat. No. 2,735,765. British Patent 2,066,975, Japanese Patent Application (OPI) No. 10539/84 and Japanese Patent Publication No. 19764/82. Examples of hindered phenols are described in U.S. Pat. No. 3,700,455, Japanese Patent Application (OPI) No. 72225/77, U.S. Pat. No. 4,228,235, and Japanese Patent Publication No. 6623/77. Examples of gallic acid derivatives, methylenedioxybenzenes, and aminophenols are described in U.S. Pat. Nos. 3,457,079 and 4,332,886, and Japanese Patent Publication No. 21144/81, respectively.

Examples of hindered amines are described in U.S. Pat. Nos. 3,336,135 and 4,268,693, British Patents 1,326,889, 1,354,313, and 1,410,846, Japanese Patent Publication No. 1420/76, and Japanese Patent Application (OPI) Nos. 114036/83, 53846/84 and 78344/84. Examples of ethers and ester derivatives of phenolic hydroxyl groups are described in U.S. Pat. Nos. 4,155,765, 4,174,220, 4,254,216, 4,264,720, and 4,279,990, Japanese Patent Application (OPI) Nos. 145530/79, 6321/80, 105147/83, and 10539/84, and Japanese Patent Publication Nos. 37856/82 and 3263/78. Examples of metal complexes are described in U.S. Pat. Nos. 4,050,938 and 4,241,155, and British Patent 2,027,731 (A).

In order to prevent deterioration of magenta dye images, especially due to light, spiroindanes described in Japanese Patent Application (OPI) No. 159644/81 and chromans substituted with a hydroquionne monoether or diether described in Japanese Patent Application (OPI) No. 89835/80 are preferably used. These compounds may be coemulsified with their respective color couplers in amounts of 5 to 100% by weight of the color couplers and then added to the light-sensitive layer to attain the desired objects. The prevention of deterioration of yellow dye images to heat, moisture, and light can be effectively accomplished by compounds having in the same molecule both hindered amine structure and hindered phenol structure, as described in U.S. Pat. No. 4,268,593. The prevention of deterioration of cyan dye image due to heat, and especially due to light, can be effectively accomplished by incorporating an ultraviolet absorber into both of the two layers adjacent to the cyan coloring layer.

In the photographic material of the present invention, the hydrophilic colloid layer may contain an ultraviolet absorber. For example, benzotriazoles having aryl groups as substituent groups as described in U.S. Pat. Nos. 3,553,794 and 4,236,013, Japanese Patent Publication No. 6540/76, and European Patent No. 57,160, butaidene as described in U.S. Pat. Nos. 4,450,229 and 4,195,999, cinnamate as described in U.S. Pat. Nos. 3,705,805 and 3,707,375, benzophenones as described in U.S. Pat. No. 3,215,530 and British Patent 1,321,355, or high molecular weight compounds having an ultraviolet absorber residual group as described in U.S. Pat. Nos. 3,761,272 and 4,431,726 can be used. In addition, ultraviolet-absorbing fluorescent whitening agents as described in U.S. Pat. Nos. 3,499,762 and 3,700,455 can be used. Typical examples of such ultraviolet absorbers are described in *Research Disclosure,* RD No. 24239 (June 1984).

In the present invention, the silver halide color photographic materials of the present invention are subjected to color development, bleach-fixing, washing with water and/or stabilizing.

The silver halide color photographic materials of the present invention can be processed by conventional color development procedures, preferably in 2 minutes and 30 seconds or less, more preferably from 30 seconds to 2 minutes. Shorter development time is preferred provided that the density of developed color is satisfactory.

It is preferred that a color developing solution used for developing the silver halide color photographic material of the present invention contain substantially no benzyl alcohol. The term "substantially no benzyl alcohol" means that benzyl alcohol is present in an amount of 2 ml/l or less, preferably 0.5 ml/l, and most preferably benzyl alcohol is absent.

In the present invention, an alkaline solution comprising an aromatic primary amine color developing agent as major ingredient is preferably employed as a color developing solution. Typical examples of the color developing agent include p-phenylenediamine compounds.

As is clear from the foregoing description, the silver halide color photographic material of the present invention is advantageous in that it is excellent in color reproduction and color image fastness and has a small gradation change due to fluctuation in treatment conditions such as treatment composition, time and temperature.

The silver halide color photographic material of the present invention shows excellent properties during the development treatment. As compared to the conventional silver halide color photographic material, the present silver halide color photographic material shows smaller gradation and sensitivity changes in sensitometry curve with the passage of color development time upon treatment thereof with an aromatic primary amine as a developing agent. Therefore, if the photographic materials in the other layers (blue-sensitive yellow coloring layer, red-sensitive cyan coloring layer) have the similar development time dependence, the present photographic material enables the reduction of the development time as well as the stabilization of the development. Thus, the silver halide color photographic material of the present invention is excellent in adaptability to rapid treatment.

The present invention will be further illustrated in the following examples, but the present invention should not be construed as being limited thereto.

In the following description, the average particle size, the coefficient of variation, and the twin content are determined on the basis of the results of measurements of 277 particles by electron microscope photography.

EXAMPLE

The silver halide grains (regular crystal emulsion A, irregular crystal emulsion B) and coupler-α, coupler-β, and coupler-γ used in Example 1 were prepared as follows:

(1) Silver halide grains

Regular crystal emulsion A

An aqueous solution of silver nitrate and an aqueous solution of an alkali halide were admixed with a gelatin aqueous solution containing an alkali halide through a double jet mixing process to prepare a regular cubic crystal emulsion of $AgBr_{0.7}Cl_{0.3}$ having an average particle size of 0.61 μm, coefficient of variation of particle size of 10%, and twin content of 0%. In the preparation of the emulsion, N,N'-dimethylethylenethiourea was used to increase the solubility of the silver halide. The emulsion thus obtained was then decanted, and the precipitate was sulfur-sensitized with thiourea to prepare a regular crystal emulsion A.

Irregular crystal emulsion B

An ammoniacal silver nitrate aqueous solution and an aqueous solution of an alkali halide were admixed with a gelatin aqueous solution containing an alkali halide through a double jet mixing process to prepare an irregular crystal emulsion of $AgBr_{0.67}Cl_{0.33}$ having an average particle size of 0.48 μm, and coefficient of variation of particle size of 26%. The emulsion thus obtained was then decanted, and the precipitate was sulfur-sensitized with thiourea to prepare an irregular crystal emulsion B.

(2) Couplers

Coupler-α

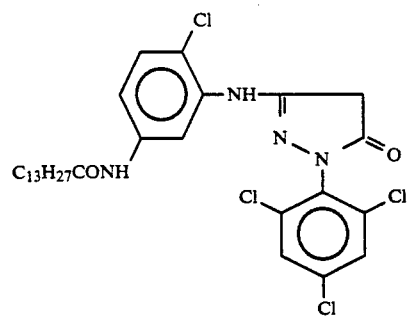

Coupler-β

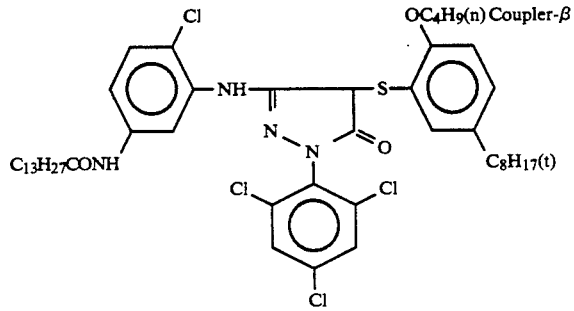

Coupler-γ

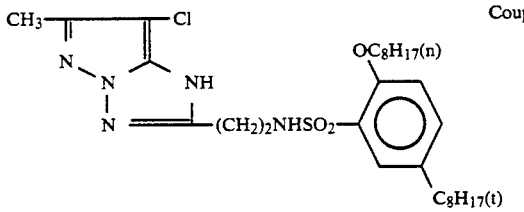

6.7 ml of trioctyl phosphate and 25 ml of ethyl acetate were added to 7.4 g of Coupler-α, and the resulting mixture was then heated so that it was dissolved. The solution thus obtained was added to 100 ml of an aqueous solution containing 10 g of gelatin and 1.0 g of sodium dodecylbenzenesulfonate, and the resulting solution of Coupler-α was then subjected to emulsification through a mechanical process. The total amount of the emulsion thus-obtained was added to 99.0 g of the regular crystal emulsion (containing 6.5 g of Ag). 10 ml of 2% 1 -hydroxy3,5-dichloro-S-triazine sodium as a hardener was added to the mixture thus obtained. The admixture thus obtained was coated on a triacetate cellulose support in an amount of 200 mg/m$^2$ in terms of silver content. A gelatin layer was then provided on the coat thus obtained to prepare a specimen $S_1$.

Similarly, specimens $S_2$, $S_3$, $S_4$, $S_5$, and $S_6$ were prepared by combining Coupler-α, Coupler-β, and Coupler-γ with Emulsion A and Emulsion B. The combinations of couplers with emulsions, the content of the components, and the used amount of trioctyl phosphate are shown in Table 1.

TABLE 1

| Specimen | Silver Halide Grains | Amount of Emulsion (g) | Coupler (g) | Trioctyl Phosphate (ml) |
|---|---|---|---|---|
| $S_1$ | A | 99.0 | α (7.4) | 6.7 |
| $S_2$ | B | 83.6 | α (7.4) | 6.7 |
| $S_3$ | A | 99.0 | β (10.9) | 9.8 |
| $S_4$ | B | 83.6 | β (10.9) | 9.8 |
| $S_5$ | A | 99.0 | γ (7.0) | 6.3 |
| $S_6$ | B | 83.6 | γ (7.0) | 6.3 |

These specimens $S_1$ to $S_6$ were then exposed to light in a manner described below, and subjected to development.

(1) Development Test 1

Specimens $S_1$ to $S_6$ were subjected to wedgewise light exposure with 1,000 C.M.S. and then to treatment with treatment solutions shown below

| Developer | |
|---|---|
| Benzyl alcohol | 15 ml |
| Diethylenetriamine pentaacetic acid | 5 g |
| KBr | 0.4 g |
| $Na_2SO_3$ | 5 g |
| $Na_2CO_3$ | 30 g |
| Hydroxyamine sulfate | 2 g |
| 4-Amino-3-methyl-N-β-(methanesulfonamido)-ethylaniline.3/2$H_2SO_4$.$H_2O$ | 4.5 g |
| Water to make | 1,000 ml |
| | pH 10.1 |
| **Bleaching Fixing Solution** | |
| Ammonium thiosulfate (70 wt %) | 150 ml |
| $Na_2SO_3$ | 5 g |
| Na[Fe(EDTA)] | 40 g |
| EDTA | 4 g |
| Water to make | 1,000 ml |
| | pH 6.8 |

| Treatment Process | Temperature | Time |
|---|---|---|
| Developer | 33° C. | 3 min. 30 sec. |
| Bleaching fixing solution | 33° C. | 1 min. 30 sec. |
| Washing with water | 28-35° C. | 3 min. |

The photographic properties of these specimens thus obtained were measured.

The results of the measurements are shown in FIG. 1 and Table 2.

FIG. 1 shows the sensitivity difference (log E (C.M.S.)) at optical densities D of 1.5, 1.0 and 0.5 in sensitometry curve plotted from the development (3 min. 30 sec.) of these specimens between upon 7 in. 00 sec. development (broken line——) and 1 min. 30 sec. development (broken line——).

Table 2 shows the sensitivity in terms of numerical values at optical densities D of 0.5, 1.0 and 1.5 at 1 min. 30 sec., 3 min. 30 sec., and 7 min. 0 sec. developments of these specimens.

TABLE 2

| | Sensitivity Difference LogE | | | |
|---|---|---|---|---|
| | 7 min. 00 sec. = 3 min. 30 sec. | | 3 min. 30 sec. − 1 min. 30 sec. | |
| Specimen | D = 1.5 − D = 1.0 | D = 1.0 = D = 0.5 | D = 1.5 − D = 1.0 | D = 1.0 − D = 0.5 |
| $S_1$ | 0.022 | 0.028 | 0.016 | −0.002 |
| $S_2$ | 0.030 | 0.060 | −0.050 | −0.020 |
| $S_3$ | −0.025 | 0.000 | 0.011 | 0.013 |
| $S_4$ | −0.025 | 0.015 | −0.016 | 0.016 |
| $S_5$ | 0.004 | 0.010 | −0.004 | −0.016 |
| $S_6$ | 0.020 | 0.003 | −0.034 | −0.006 |

E: C.M.S.

It can be seen in FIG. 1 and Table 2 that Specimen 5, i.e. combination of Coupler-γ (pyrazolotriazole coupler) and the regular crystal emulsion A provides a silver halide photographic material which shows the smallest sensitivity and gradation changes in sensitometry curve.

(2) Development Test 2

Specimens $S_1$ to $S_6$ were light-exposed in the same manner as used in Development Test 1 and then subjected to the following continuous treatments by means of a Fuji color roll processor FRRP-115 (Fuji Photo Film Co., Ltd.).

| Process | Treatment Time | Temperature | Tank Volume |
|---|---|---|---|
| Color development | 3 min. 30 sec. | 38° C. ± 0.3° C. | 60 l |
| Bleaching fixing | 1 min. 30 sec. | 33° C. ± 1° C. | 40 l |
| Rinsing 1 | 1 min. | 33° C. ± 3° C. | 20 l |
| Rinsing 2 | 1 min. | 33° C. ± 3° C. | 20 l |
| Rinsing 3 | 1 min. | 33° C. ± 3° C. | 20 l |

The rinsing was a three-stage counter flow rinsing consisting of Rinsing 1, Rinsing 2, and Rinsing 3. (The rinsing process proceeded from Rinsing 3 to Rinsing 1.)

The amount of the treatment solution carried over from the bleaching fixing process to Rinsing 3 was 60 ml/$m^2$ for each tank.

| Composition of Treatment Solution (Color Developer) | Tank Solution | Supplementary Solution |
|---|---|---|
| Water | 800 ml | 800 ml |
| Trisodium nitriloacetate | 2.0 g | 2.0 g |
| Benzyl alcohol | 14 ml | 18 ml |
| Diethylene glycol | 10 ml | 10 ml |
| Sodium sulfite | 2.0 g | 2.5 g |
| Hydroxyamine sulfate | 3.0 g | 3.5 g |
| Potassium bromide | 1.0 g | — |
| Sodium carbonate | 30 g | 35 g |
| N-Ethyl-N-(β-methanesulfonamidoethyl)-3-methyl-4-aminoaniline sulfate | 5.0 g | 8.0 g |
| Water to make | 1,000 ml | 1,000 ml |
| pH | 10.15 | 10.65 |

The conditions of the bleaching fixing process were the same for all of the specimens. The amount of the bleaching fixing solution supplied was 60 ml per $m^2$ of the light-sensitive material. The composition of the bleaching fixing solution was as follows:

Bleaching-fixing (blix) solution:

| | Tank Solution | Supplementary Solution |
|---|---|---|
| Water | 400 ml | 400 ml |
| Ammonium thiosulfate (70%) | 150 ml | 300 ml |
| Sodium sulfite | 18 g | 36 g |
| Iron (III) ammonium ethylenediamine tetraacetate | 55 g | 110 g |
| Disodium ethylenediaminetetraacetate | 5 g | 10 g |
| Water to make | 1,000 ml | 1,000 ml |
| pH | 6.70 | 6.50 |

The conditions of the rinsing process were the same for all the specimens. The amount of the rinsing solution supplied was 250 ml per $m^2$ of the light-sensitive material. The composition oft he rinsing solution was as follows.

| | |
|---|---|
| 1-Hydroxyethylidene-1,1-diphosphonic acid (60%) | 2.0 ml |
| Aluminum sulfate | 1.0 g |
| Sulfanilamide | 0.1 g |

Figure 2:
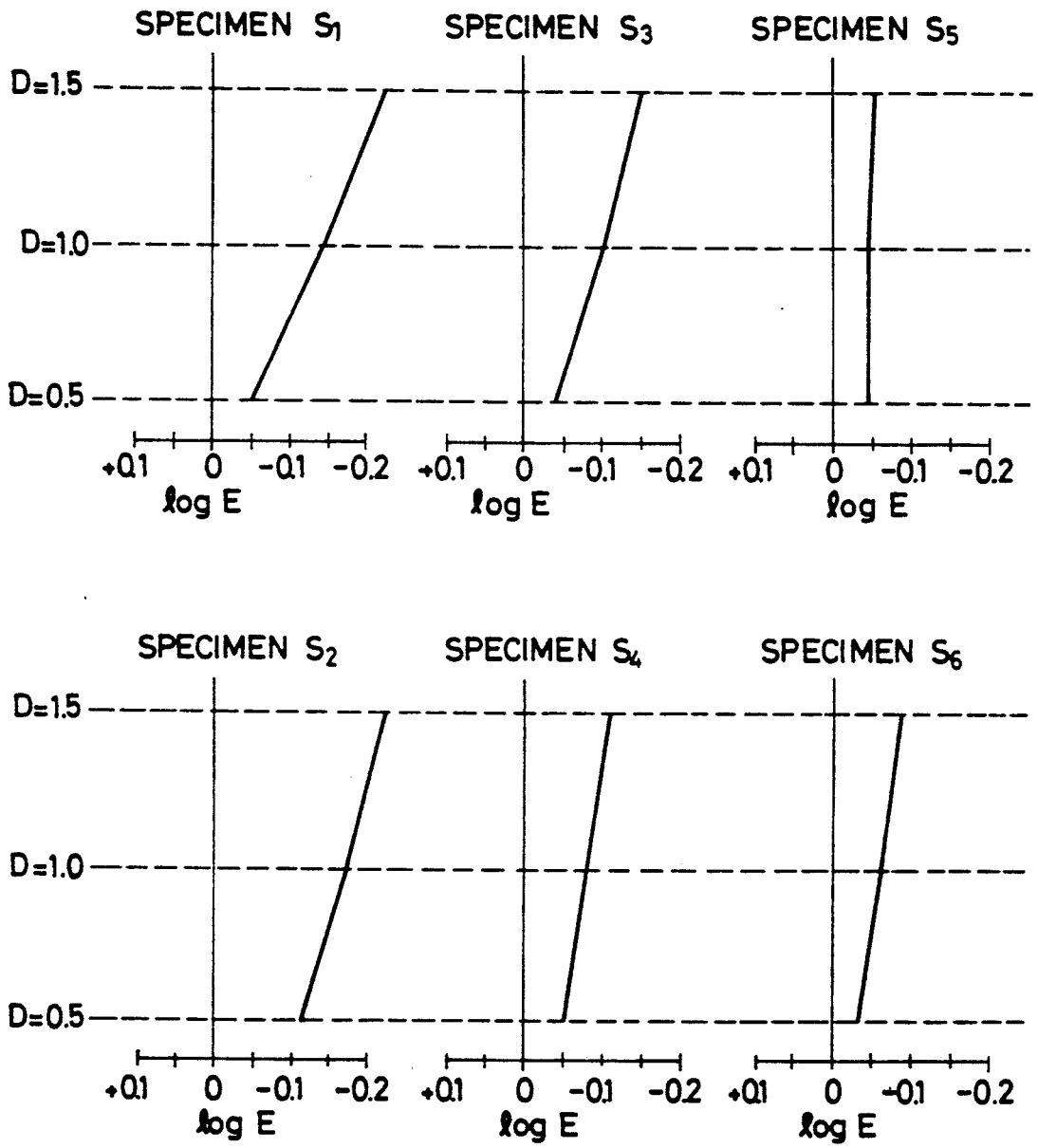
FIGS. 2 and 4 show graphs illustrating the relationship between variations in the treatment composition and the sensitometry of silver halide color photographic materials.

Water was added to the above composition in an amount such that the volume thereof reached 1 l. Ammonia water was added to the solution in such a manner that the pH thereof reached 7.0. The results of the measurement of sensitometry made when 400 $m^2$ of each specimen was treated are shown in FIG. 2 and Table 3. FIG. 2 shows changes of the sensitometry curve for each specimen from when obtained by treatment solution which had just been prepared to when obtained by treatment solution which had been used for treatment of 400 $m^2$ of the specimen.

Table 3 shows the sensitivity difference in terms of numerical values at optical densities D of 0.5, 1.0 and 1.5 for each specimen.

TABLE 3

| Specimen | Sensitivity Difference LogE (C.M.S | |
|---|---|---|
| | D = 1.5 − D = 1.0 | D = 1.0 − D = 0.5 |
| $S_1$ | −0.075 | −0.095 |
| $S_2$ | −0.047 | −0.061 |
| $S_3$ | −0.046 | −0.030 |
| $S_4$ | −0.030 | −0.040 |
| $S_5$ | −0.007 | −0.000 |
| $S_6$ | −0.024 | −0.032 |

It can be seen from FIG. 2 and Table 3 that Specimen 5, i.e., combination of Coupler-γ (pyrazoloazole coupler) and the regular crystal emulsion A provides a silver halide photographic material which shows only very small sensitivity and gradation changes in sensitometry curve even when the total amount of the light-sensitive material treated reached 400 $m^2$.

EXAMPLE 2

In Example 2, the effect of the coefficient of variation of particle size of the silver halide emulsion on the photographic properties of the specimens were examined. Three types of regular crystal emulsions having different average particle sizes which had been prepared in the same manner as used for the regular crystal emulsion A in Example 1 were mixed with each other to prepare a regular cubic crystal emulsion A' of $AgBr_{0.7}Cl_{0.3}$ having an average particle size of 0.61 μm, coefficient of variation of particle size of 22%, and twin constant of 0%. Specimens $S_7$, $S_8$, and $S_9$ were obtained by combining the emulsion A' and Coupler-α, Coupler-β and Coupler-γ. These specimens are shown in Table 4.

TABLE 4

| Specimen | Silver Halide Grain | Amount of Emulsion (g) | Coupler (g) | Trioctyl Phosphate (ml) |
|---|---|---|---|---|
| $S_7$ | A' | 99.0 | α (7.4) | 6.7 |
| $S_8$ | A' | 99.0 | β (10.9) | 9.8 |
| $S_9$ | A' | 99.0 | γ (7.0) | 6.3 |

These specimens were light-exposed and treated in the same manner as in Development Test 1 of Example 1.

Figure 3:
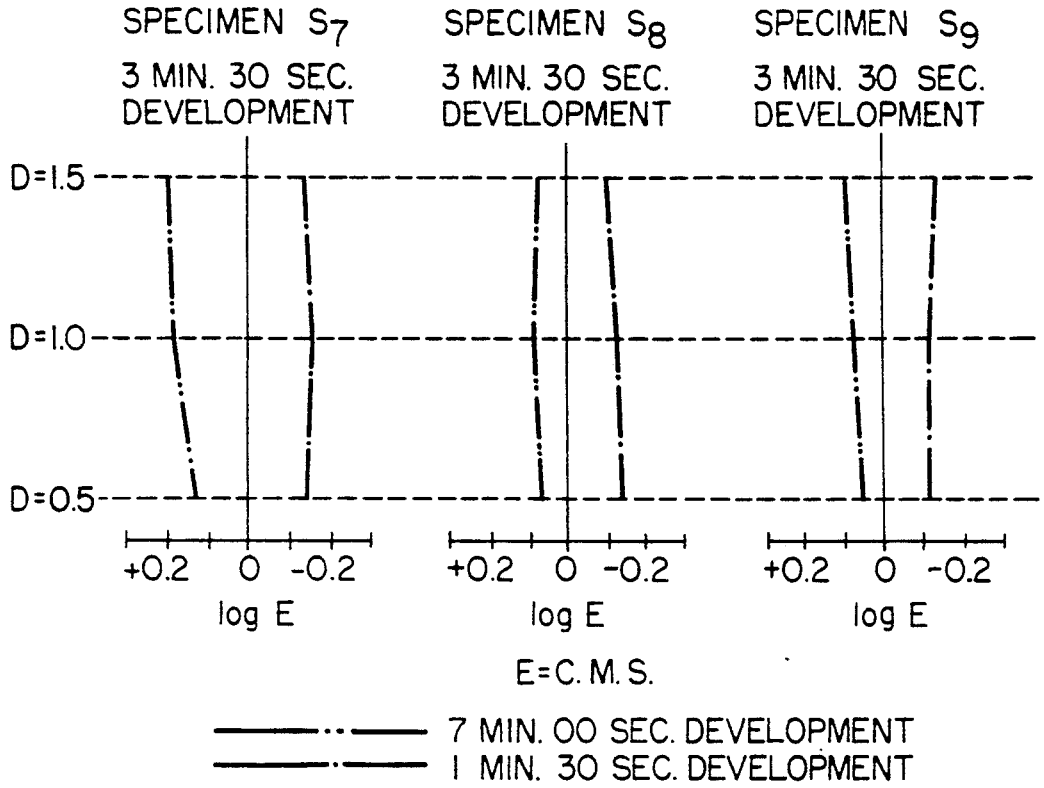

FIG. 3 and Table 5 show the sensitometry of these specimens, indicating the photographic properties of $S_7$, $S_8$ and $S_9$, compared to FIG. 1 and Table 2, which show the results of Development Test 1 of Example 1.

TABLE 5

| Specimen | Sensitivity Difference LogE | | | |
|---|---|---|---|---|
| | 7 min. 00 sec. − 3 min. 30 sec. | | 3 min. 30 sec. − 1 min. 30 sec. | |
| | D = 1.5 − D = 1.0 | D = 1.0 − D = 0.5 | D = 1.5 − D = 1.0 | D = 1.0 − D = 0.5 |
| $S_7$ | 0.020 | 0.050 | 0.018 | −0.018 |
| $S_8$ | −0.080 | 0.012 | 0.020 | 0.012 |
| $S_9$ | 0.011 | 0.013 | −0.018 | −0.011 |

E: C.M.S.

The comparison of FIG. 3 with FIG. 1 and of Table 5 with Table 2 show that Specimen $S_5$, i.e., combination of the regular crystal emulsion A having a high monodispersibility (coefficient of variation of size of silver halide particles: 10%) and Coupler-γ provides a silver halide photographic material which shows smaller sensitivity and gradation changes in sensitometry curve as compared to Specimen $S_9$, i.e., combination of the regular crystal emulsion A' having a low monodispersibility (coefficient of variation of size of silver halide particles: 22%) and Coupler-γ. It can be also shown that $S_9$ provides a silver halide photographic material which shows a smaller gradation change than Specimen $S_6$, which is the combination of the irregular crystal emulsion B and Coupler-γ.

Specimens $S_7$, $S_8$ and $S_9$ were then light-exposed and treated in the same manner as used in Example 2. The change of the sensitometry curve from the case when obtained from the treatment solution which had just been prepared to the case when the amount of $S_7$, $S_8$ and $S_9$ treated reached 400 m each was examined. The results are shown in FIG. 4 and Table 6, compared to FIG. 2 and Table 3, which show the results of Development Test 2 of Example 1.

TABLE 6

| Specimen | Sensitivity Difference logE (C.M.S.) | |
|---|---|---|
| | D = 1.5 − D = 1.0 | D = 1.0 − D = 0.5 |
| $S_7$ | −0.060 | −0.104 |
| $S_8$ | −0.053 | −0.053 |
| $S_9$ | −0.020 | −0.025 |

Figure 4:
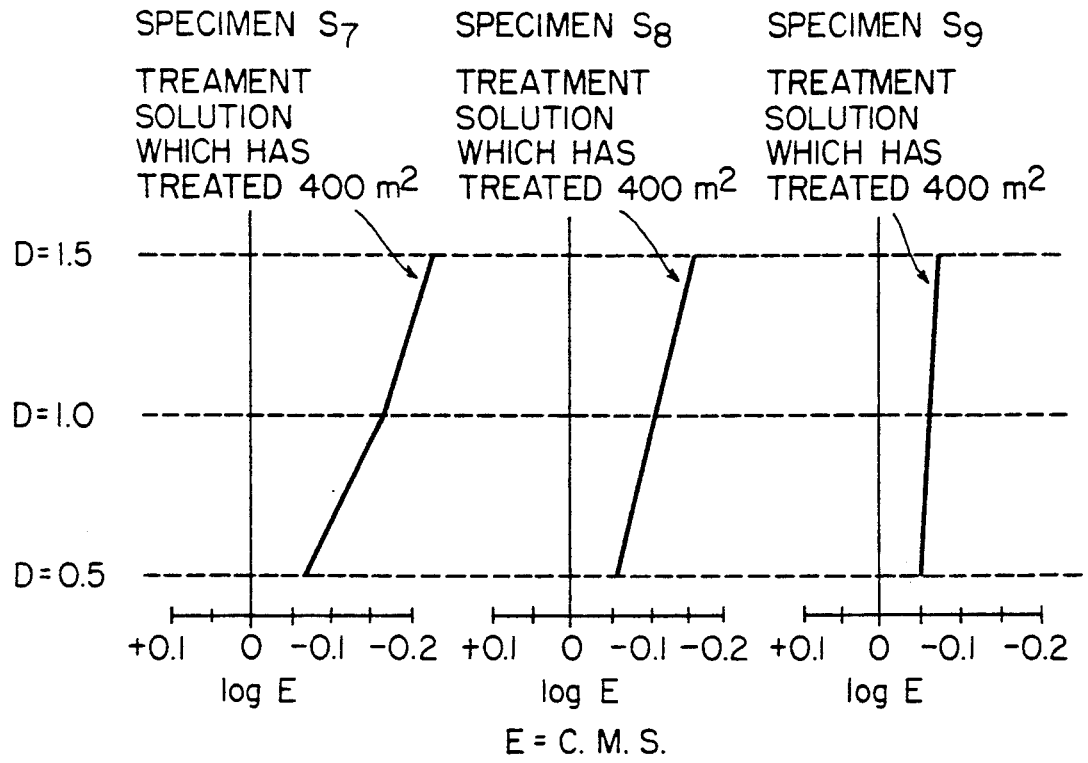

The comparison of FIG. 4 with FIG. 2 and of Table 6 with Table 3 show that Specimen $S_5$, i.e., combination of the regular crystal emulsion A having a high monodispersibility (coefficient of variation of size of silver halide particles: 10%) and Coupler-γ provides a silver halide light-sensitive material which shows a smaller sensitivity and gradation change in sensitometry curve as compared to Specimen $S_9$, which is the combination of the regular crystal emulsion A' having a low monodispersibility (coefficient of variation of size of silver halide particles: 22%), when the amount of the specimen treated with a solution which had just been prepared reached 400 $m^2$. It can also been shown that Specimen $S_9$ shows a smaller gradation change than Specimen $S_6$, which is the combination of the irregular crystal emulsion B and Coupler-γ.

EXAMPLE 3

This example is intended to test the effect of the present invention in a rapid development processing system suited for processing a large amount of color photographic light-sensitive material.

On a paper support, both surfaces of which were laminated with polyethylene, were coated layers as shown in Table 7 below in order to prepare a multilayer color photographic light-sensitive material for a printing paper. The coating solutions were prepared in the following manner.

Preparation of Coating Solution for First Layer 16.6 of Yellow Coupler (a) and 4.4 g of Color Image Stabilizer (b) were dissolved in a mixture of 27.2 ml of ethyl acetate and 6.9 ml of Solvent (c) and the resulting solution was dispersed in 185 ml of a 10% aqueous solution of gelatin containing 8 ml of a 10% aqueous solution of sodium dodecylbenzenesulfonate. Separately, to a silver chlorobromide emulsion (having a bromide content of 10 mol % and containing 70 g of silver per Kg of the emulsion) was added $7.0\times10^{-4}$ mols of a blue-sensitive dye shown below per mole of the silver chlorobromide to prepare a blue-sensitive emulsion. The above described dispersion was mixed with 90 g of the blue-sensitive silver chlorobromide emulsion, with the concentration of the resulting mixture being controlled with gelatin, to form the composition shown in Table 7 below, i.e., the coating solution for the first layer.

Coating solutions for the second layer to the seventh layer were prepared so that the compositions described in Table 7 were obtained. 1-Hydroxy-3,5-dichloro-s-triazine sodium salt was used as a gelatin hardener in each layer.

The following spectral sensitizing dyes were employed in the emulsion layers, respectively.

Blue-Sensitive Emulsion Layer

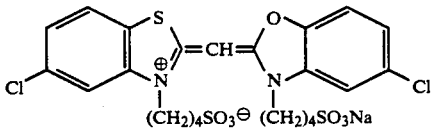

($7.0 \times 10^{-4}$ mol per mol of silver halide)

Green-Sensitive Emulsion Layer

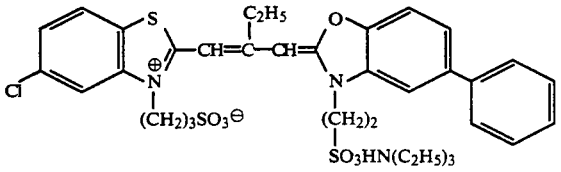

($4.0 \times 10^{-4}$ mol per mol of silver halide)

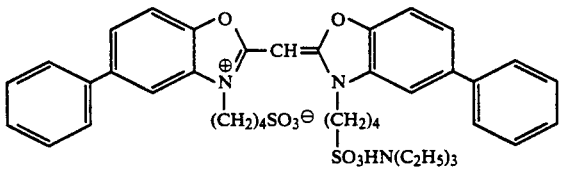

($7.0 \times 10^{-5}$ mol per mol of silver halide)

Red-Sensitive Emulsion Layer

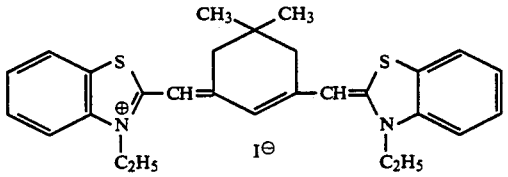

($1.0 \times 10^{-4}$ mole per mole of silver halide)

The following dyes were employed as irradiation preventing dyes in the emulsion layers, respectively, Green-Sensitive Emulsion Layer

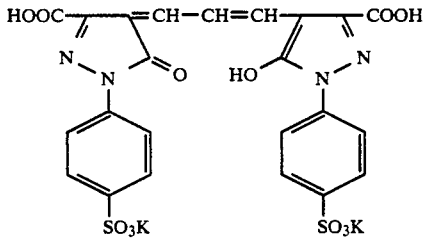

Red-Sensitive Emulsion Layer

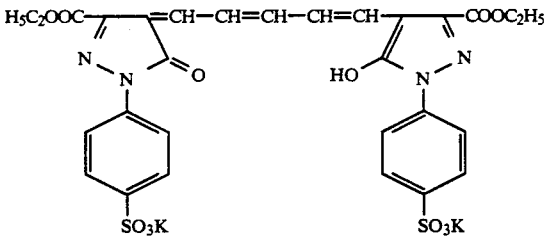

The compounds used in the above layers have the structures shown below respectively.

Yellow Coupler (a)

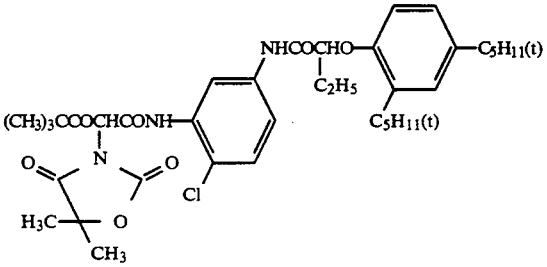

Color Image Stabilizer (b)

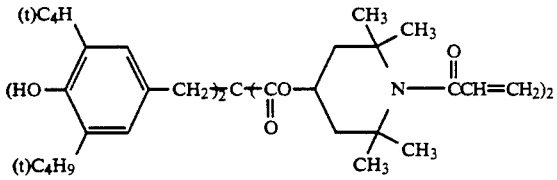

Solvent (c)

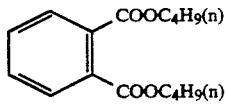

Color Mixing Preventing Agent (d)

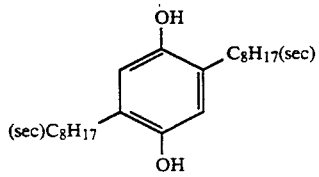

Ultraviolet Light Absorbing Agent (e)
A mixture of

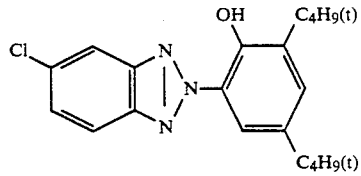

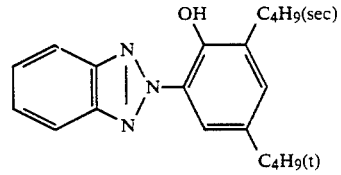

and

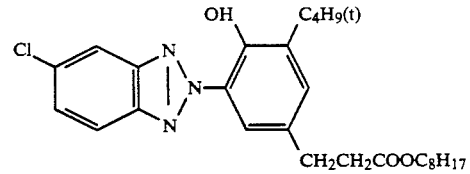

in a ratio of 1:5:3 by mole.
Color Mixing Preventing Agent (f)

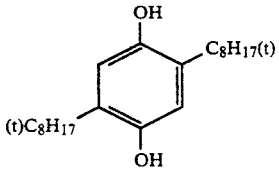

Solvent (g)

$(iso—C_9H_{19}O)_3P=O$

Cyan Coupler (h)

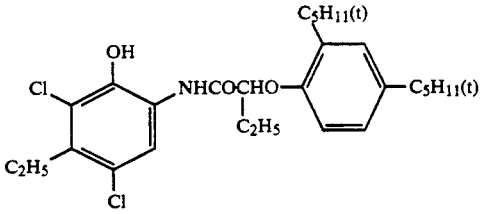

Color Image Stabilizer (i)

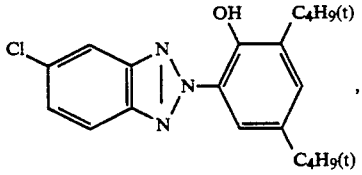

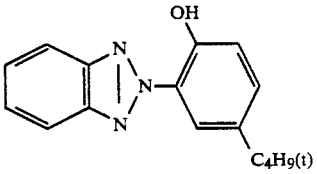

and

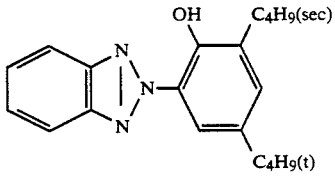

in a ratio of 1:3:3 by mole.
Solvent (j)

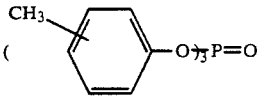

TABLE 7

| Layer | Main Composition | Amount Used |
|---|---|---|
| Seventh Layer (Protective layer) | Gelatin | 1.33 g/m$^2$ |
| | Acryl-modified polyvinyl alcohol copolymer (degree of modification: 17%) | 0.17 g/m$^2$ |
| Sixth Layer (Ultraviolet light absorbing layer) | Gelatin | 0.54 g/m$^2$ |
| | Ultraviolet Light absorbing agent (e) | 0.21 g/m$^2$ |
| | Solvent (g) | 0.09 cc/m$^2$ |
| Fifth Layer (Red-sensitive layer) | Silver Chlorobromide Emulsion (silver bromide: 10 mol %) | 0.26 g/m$^2$ (as silver) |
| | Gelatin | 0.98 g/m$^2$ |
| | Cyan Coupler (h) | 0.41 g/m$^2$ |
| | Color Image Stabilizer (i) | 0.17 g/m$^2$ |
| | Solvent (j) | 0.25 cc/m$^2$ |
| Fourth Layer (Ultraviolet light absorbing layer) | Gelatin | 1.60 g/m$^2$ |
| | Ultraviolet Light Absorbing Agent (e) | 0.62 g/m$^2$ |
| | Color Mixing Preventing Agent (f) | 0.05 g/m$^2$ |
| | Solvent (g) | 0.26 cc/m$^2$ |
| Third Layer (Green-sensitive | Shown in Table 8 | Shown in Table 8 |
| | Gelatin | " |

TABLE 7-continued

| Layer | Main Composition | Amount Used |
|---|---|---|
| layer) | Magenta Coupler | " |
| | Color Image Stabilizer | " |
| | Solvent | " |
| Second layer (Color mixing protecting layer) | Gelatin | 0.99 g/m$^2$ |
| | Color Mixing Preventing Agent (d) | 0.08 g/m$^2$ |
| First Layer (Blue-sensitive layer) | Silver Chlorobromide Emulsion (silver bromide: 10 mol %) | 0.30 g/m$^2$ |
| | Gelatin | 1.86 g/m$^2$ |
| | Yellow Coupler (a) | 0.71 g/m$^2$ |
| | Color Image Stabilizer (b) | 0.19 g/m$^2$ |
| | Solvent (c) | 0.80 g/m$^2$ |
| Support | Polyethylene laminated paper (the polyethylene coating containing a white pigment ($TiO_2$, etc.) and a bluish dye (ultramarine, etc.) on the first layer side). | |

In order to examine the effect of the present invention, silver halide emulsions C and D, and Couplers $\beta$, $\delta$ and $\epsilon$ were added to the coating solution for the third layer in amounts shown in Table 8 below.

Silver Halide Grains

Regular crystal emulsion C

An aqueous solution of silver nitrate and an aqueous solution of an alkali halide (bromide: chloride=1:9 by mole) were admixed with a gelatin aqueous solution containing sodium chloride (0.1 mole per mole of silver nitrate) through a double jet mixing process to prepare a regular cubic crystal emulsion of $AgBr_{0.1}Cl_{0.9}$ having an average particle size of 0.46 μm, coefficient of variation of particle size of 12%, and twin content of 0%. In the preparation of the emulsion, N,N'-dimethylethylenethiourea was used to increase the solubility of the silver halide.

Irregular crystal emulsion D

The same procedure as above were repeated except that the amount of sodium chloride contained in the aqueous gelatin solution was changed to 0.5 mole per mole of silver nitrate and that N,N'-dimethylethylenethiourea was eliminated to prepare an irregular crystal emulsion of $AgBr_{0.1}Cl_{0.9}$ having an average particle size of 0.52 μm, coefficient of variation of particle size of 28% and twin content of 55%.

The following couplers and color image stabilizer were used.

Coupler δ

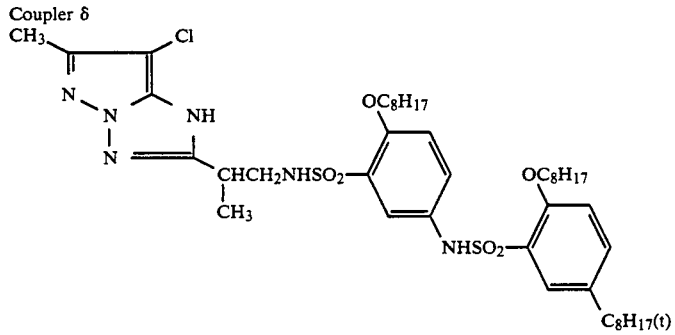

Coupler ε

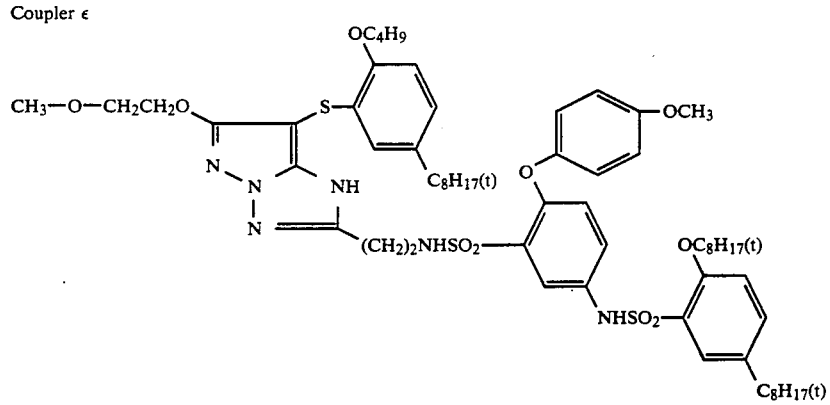

Color Image Stabilizer k

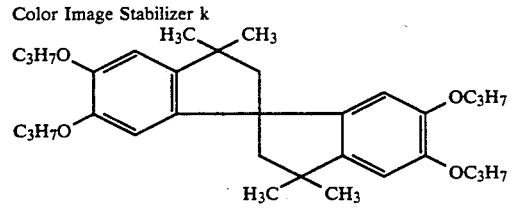

TABLE 8

| Specimen | Composition | Amount |
|---|---|---|
| $S_{10}$ | Emulsion C (regular crystal $AgBr_{0.1}Cl_{0.9}$) Ag | 0.20 g/m$^2$ |
| | Gelatin | 1.80 g/m$^2$ |
| | Magenta Coupler ($\beta$) | 0.37 g/m$^2$ |

TABLE 8-continued

| Specimen | Composition | Amount |
|---|---|---|
| | Color Image Stabilizer (k) | 0.21 g/m$^2$ |
| | Solvent (j) | 0.37 cc/m$^2$ |
| $S_{11}$ | Emulsion C (regular crystal $AgBr_{0.1}Cl_{0.9}$) Ag | 0.20 g/m$^2$ |
| | Gelatin | 1.80 g/m$^2$ |
| | Magenta Coupler (δ) | 0.46 g/m$^2$ |
| | Color Image Stabilizer (k) | 0.27 g/m$^2$ |
| | Solvent (j) | 0.46 cc/m$^2$ |
| $S_{12}$ | Emulsion C (regular crystal $AgBr_{0.1}Cl_{0.9}$) Ag | 0.20 g/m$^2$ |
| | Gelatin | 1.80 g/m$^2$ |
| | Magenta Coupler (ε) | 0.48 g/m$^2$ |
| | Color Image Stabilizer (k) | 0.21 g/m$^2$ |
| | Solvent (j) | 0.48 cc/m$^2$ |
| $S_{13}$ | Emulsion D (irregular crystal $AgBr_{0.1}Cl_{0.9}$) Ag | 0.20 g/m$^2$ |
| | Gelatin | 1.80 g/m$^2$ |
| | Magenta Coupler (β) | 0.37 g/m$^2$ |
| | Color Image Stabilizer (k) | 0.21 g/m$^2$ |
| | Solvent (j) | 0.37 cc/m$^2$ |
| $S_{14}$ | Emulsion D (irregular crystal $AgBr_{0.1}Cl_{0.9}$) Ag | 0.20 g/m$^2$ |
| | Gelatin | 1.80 g/m$^2$ |
| | Magenta Coupler (δ) | 0.46 g/m$^2$ |
| | Color Image Stabilizer (k) | 0.27 g/m$^2$ |
| | Solvent (j) | 0.46 cc/m$^2$ |
| $S_{15}$ | Emulsion D (irregular crystal $AgBr_{0.1}Cl_{0.9}$) Ag | 0.20 g/m$^2$ |
| | Gelatin | 1.80 g/m$^2$ |
| | Magenta Coupler (ε) | 0.48 g/m$^2$ |
| | Color Image Stabilizer (k) | 0.21 g/m$^2$ |
| | Solvent (j) | 0.48 cc/m$^2$ |

Specimens $S_{10}$ to $S_{15}$ were subjected to wedgewise exposure for sensitometry through a green filter using a sensitometer (FWH type, Fuji Photo Film Co., Ltd.; color temperature of light source: 3200° K.) so that an exposure of 250 C.M.S. was obtained.

Thereafter the specimens were processed using the processing solutions and according to the steps of color development, bleaching-fixing and rinsing. Photographic properties of the specimens were examined with varying development time, i.e., 30 seconds, 45 seconds and 60 seconds.

Evaluation of the photographic properties of the specimens was performed in the same manner as in Example 1, that is, the sensitivity differences (logE (C.M.S.)), ($D_{1.5}$-$D_{1.0}$) and ($D_{1.0}$-$D_{0.5}$) wherein $D_{0.5}$, $D_{1.0}$ and $D_{1.5}$ mean optical densities D of 0.5, 1.0 and 1.5 in sensitometry curve plotted from the development at 30 seconds, 45 seconds and 60 seconds, respectively, were used as indices of variation in the photographic properties against fluctuation in development conditions.

Figure 5:
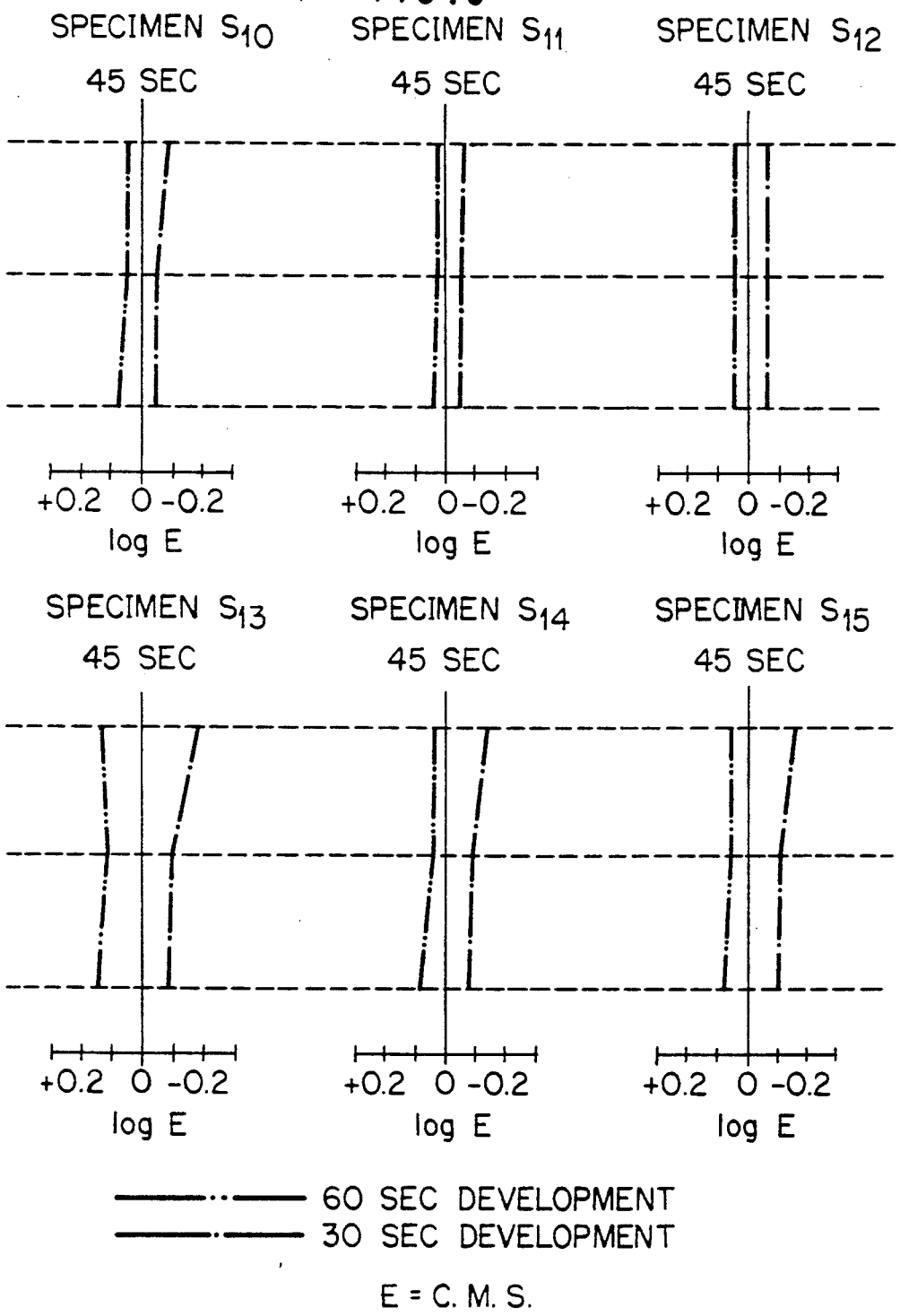

The results obtained are shown in FIG. 5 and Table 9.

The experiment was carried out according to the following procedures.

| Process | Temperature (°C.) | Time |
|---|---|---|
| Color Development | 35 | 30 sec, 45 sec, 60 sec |
| Bleach-Fixing | 35 | 45 sec |
| Washing with Water | 30 | 1 min 30 sec |
| Drying | 70 | 1 min |

The composition of each processing solution was as follows.

| | |
|---|---|
| Color Developing Solution | |
| Pentasodium diethylenetriamine-pentaacetic acid | 2.0 g |
| Sodium sulfite | 1.7 g |
| Potassium carbonate | 31.7 g |
| Sodium hydrogen carbonate | 0.7 g |
| Potassium bromide | 0.15 g |
| N-Ethyl-N-(β-methanesulfonamidoethyl)-3-methyl-4-aminoaniline sulfonate | 4.5 g |
| Hydroxylamine sulfate | 3.0 g |
| Fluorescent whitening agent (Stilbene based) | 1.0 g |
| Water to make | 1,000 ml<br>pH (at 25° C.) 10.20 |
| Bleach-Fixing Solution | |
| Ammonium thiosulfate (70 wt/mol % soln.) | 150 ml |
| Sodium sulfite | 18 g |
| Ammonium ethylenediamine-tetraacetate iron (III) | 55 g |
| Disodium ethylenediaminetetraacetate | 5 g |
| Water to make | 1,000 ml<br>pH (at 25° C.) 6.75 |

TABLE 9

| | Sensitivity Difference LogE | | | |
|---|---|---|---|---|
| | 60 sec. − 45 sec. | | 45 sec. − 30 sec. | |
| Specimen | D = 1.5 − D = 1.0 | D = 1.0 − D = 0.5 | D = 1.5 − D = 1.0 | D = 1.0 − D = 0.5 |
| $S_{10}$ | −0.005 | −0.022 | −0.036 | −0.011 |
| $S_{11}$ | −0.006 | −0.013 | −0.007 | −0.010 |
| $S_{12}$ | −0.004 | −0.008 | −0.006 | −0.004 |
| $S_{13}$ | 0.021 | −0.026 | −0.089 | −0.018 |
| $S_{14}$ | −0.005 | −0.033 | −0.051 | −0.017 |
| $S_{15}$ | −0.004 | −0.021 | −0.042 | −0.015 |

E: C.M.S.

It is apparent from the results of the above experiments that the effects attainable by a combination of a regular crystal emulsion and a pyrazoloazole coupler, i.e., small sensitivity and gradation changes in sensitometry curve are observed also in a rapid development processing system which is suitable for a large amount of a color photographic light-sensitive material in a short time.

In a rapid development processing system as in the example, the fact that the photographic properties of color photographic light-sensitive materials are not adversely affected by fluctuation of development time is very advantageous since development processing is carried out in a short time, and therefore stable or uniform rapid development can be put into practice according to the present invention.

Herein, C.M.S. is the abbreviation of candle-meter-second (or meter-candle-second). Further, illuminence means incident luminous per unit area of the surface.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a pyrazoloazole coupler and silver halide grains consisting of regular crystals with a twin content of 5% or less, said silver halide grains being represented by the formula (I)

$$AgCl_xB_yI_{1-x-y} \quad (I)$$

wherein x and y satisfy the relationship $0 \leqq x \leqq 1$, $0 \leqq y \leqq 1$, and $0 \leqq 1-x-y \leqq 0.02$, wherein the coefficient of variation of size of the silver halide grains is 12% or less, the average particle size of the silver halide grains is from 0.2 to 0.9 μm and wherein said pyrazoloazole coupler is represented by formula (VIII):

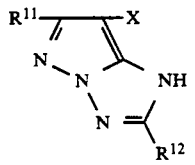

wherein $R^{11}$ and $R^{12}$, which may be the same or different, each represents a hydrogen atom, a halogen atom, an alkyl group, an aralkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamin group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group, and X represents a hydrogen atom, a halogen atom, a carboxy group or a group which is bonded to the carbon atom at the coupling position thereof via an oxygen, nitrogen, or sulfur atom and liberated upon coupling, or $R^{11}$, $R^{12}$, or X may be a divalent group to form a bis compound.

2. A silver halide color photographic material as in claim 1, wherein said regular crystals comprise cubic grains having an external shape surrounded by (100) planes, rhombic dodecahdedral grain shaving an external shape surrounded by (110) planes, regular octahedral grains having an external shape surrounded by (111) planes, and tetradecahedral grains having an external shape surrounded by (100) and (111) planes.

3. A silver halide color photographic material as in claim 1, wherein the average particle size of the silver halide is from 0.3 to 0.7 μm.

4. A silver halide color photographic material as in claim 1, wherein said silver halide grains consisting of regular crystals with a twin content of 5% or less are prepared by forming the silver halide grains in the presence of a silver halide solvent selected from thioethers, amines, thioureas, ammonia, and thiocyanates.

5. A silver halide color photographic material as in claim 4, wherein said silver halide solvent is a thiourea compound represented by formula (X)

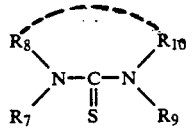

(X)

wherein $R_7$, $R_8$, $R_9$, and $R_{10}$ each represents an alkyl group having from 1 to 4 carbon atoms, or $R_8$ and $R_{10}$ together form a 5- or 6-membered ring.

6. A silver halide color photographic material as in claim 5, wherein said compound represented by formula (X) is present at the time of formation of the silver halide grains in an amount of from $5 \times 10^{-3}$ to $5 \times 10^{-6}$ per mole of silver halide precipitated.

7. A silver halide color photographic material as in claim 1, wherein said color photographic material comprises a high boiling point organic solvent selected from the group consisting of a phthalic ester, a phosphoric ester, a phosphonic ester, a benzoate, an alcohol, a phenol, an aliphatic carboxylic ester, an aniline derivative and a hydrocarbon.

8. A silver halide color photographic material as in claim 7, wherein said color photographic material comprises an auxiliary organic solvent having a boiling point in the range of from about 30° to 160° C.

9. A silver halide color photographic material as in claim 8, wherein said auxiliary organic solvent is selected from the group consisting of ethyl acetate, butyl acetate, ethyl propionate, methyl ethyl ketone, cyclohexanone, 2-ethoxyethyl acetate, and dimethylformmade.

10. A silver halide color photographic material as in claim 1, wherein said color photographic material further comprises an α-pivaloylacetanilide coupler having a nitrogen atom or oxygen atom-containing releasing group wherein the nitrogen or oxygen atom is attached to the coupling position as a yellow coupler and/or a phenol type coupler in which at least the 2-position is substituted with an acylamine group and the 5-position is substituted with an alkyl group having 2 or more carbon atoms as a cyan coupler.

11. A silver halide color photographic material as in claim 1, wherein $R^{11}$, $R^{12}$ or X represents a divalent group forming a bis compound.

12. A silver halide color photographic material as in claim 11, wherein $R^{11}$ and $R^{12}$ each X represents an unsubstituted alkylene group having 1 to 16 carbon atoms or a substituted alkylene group having about 10 to about 100 carbon atoms in total per pyrazoloazole ring, an unsubstituted phenylene group or a substituted phenylene group having about 6 to 100 carbon atoms in total per pyrazoloazole ring, an NHCO—$R^{14}$—CONH— group in which $R^{14}$ represents an unsubstituted alkylene group having 1 to 16 carbon atoms or a substituted alkylene group having about 10 to 100 carbon atoms in total per pyrazoloazole ring or an unsubstituted phenylene group or a substituted phenylene group having about 6 to about 100 carbon atoms in total per pyrazoloazole ring, or an —S—$R^{14}$—S— group in which $R^{14}$ represents an unsubstituted alkylene group having 1 to about 16 carbon atoms or a substituted alkylene group having about 10 to about 100 carbon atoms in total per pyrazoloazole ring; and X represents a divalent group derived from one of monovalent groups represented by X and having another bond at proper portions.

13. A silver halide color photographic material as in claim 12, wherein said monovalent group represented by X is a carboxy group, a group having an oxygen linkage, a group having a nitrogen linkage, or a group having a sulfur linkage.

14. A silver halide color photographic material as in claim 13, wherein said monovalent group represented by X is an alkoxyphenylthio group having 1 to 12 carbon atoms in the alkoxy moiety.

15. A silver halide color photographic material as in claim 14, wherein said alkoxyphenylthio group is substituted with an alkyl group attached to the 4- or 5-position of the phenyl moiety.

16. A silver halide color photographic material as in claim 15, wherein said alkyl group is attached to the 5-position of the phenyl moiety.

17. A silver halide color photographic material as in claim 1, wherein said pyrazoloazole coupler is a polymeric coupler.

18. A silver halide color photographic material as in claim 17, wherein said polymeric coupler has a molecular weight of from about 10,000 to about 200,000.

19. A silver halide color photographic material as in claim 17, wherein said polymeric coupler is a copolymer of a monomer having a group based on formula (II) with a non-coloring ethylenic monomer which does not undergo coupling with an oxide of an aromatic primary amine developing agent.

20. A silver halide color photographic material as in claim 17, wherein said polymeric coupler is a homopolymer of a monomer represented by formula (II) and having a vinyl group.

21. A silver halide color photographic material as in claim 1, wherein said pyrazoloazole coupler is a polymeric coupler of a monomer comprising a coupler residual group represented by a radical derived from formula (VII) present in the main polymeric chain or a side chain thereof.

22. A silver halide color photographic material as in claim 21, wherein $R^{11}$, $R^{12}$ or X represents a vinyl group or a linking group.

23. A silver halide color photographic material as in claim 1, wherein said pyrazoloazole coupler is a polymer coupler of a vinyl monomer containing a radical derived from formula (VIII) as a moiety thereof in which the linking group represented by $R^{11}$, $R^{12}$, or X is a combination of groups selected from an unsubstituted alkylene group having 1 to 16 carbon atoms or a substituted alkylene group having about 10 to about 100 carbon atoms in total per pyrazoloazole ring, an unsubstituted phenylene group or a substituted phenylene group having about 6 to 100 carbon atoms in total per pyrazoloazole, —NHCO—, —CONH—, —O—, —OCO—, and an unsubstituted aralkylene group having about 8 to 100 carbon atoms per per pyrazoloazole ring or a substituted aralkylene group having about 8 to about 100 carbon atoms per pyrazoloazole ring.

24. A silver halide color photographic material as in claim 23, wherein said linking group is selected from the group consisting of —NHCO—, $—CH_2CH_2—$,

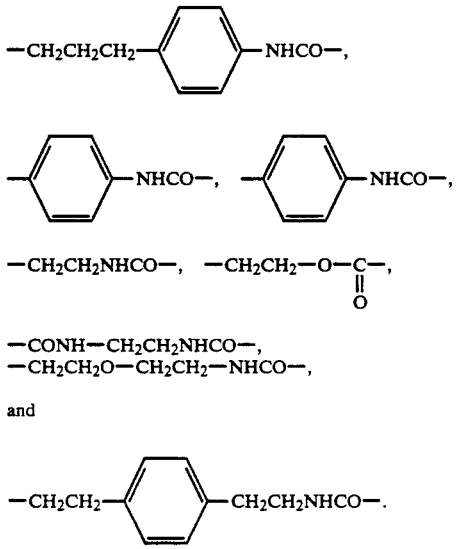

and

25. A silver halide color photographic material as in claim 23, wherein said vinyl monomer further comprises a substituent group selected from the group consisting of a hydrogen atom, a chlorine atom and an alkyl group having 1 to 4 carbon atoms.

26. A silver halide color photographic material as in claim 21, said polymeric coupler is a copolymer with a non-coloring ethylenic monomer which does not undergo coupling with an oxide of an aromatic primary amine developing agent.

27. A silver halide color photographic material as in claim 1, wherein the number of total carbon atoms of $R^{11}$, $R^{12}$ and $R^{13}$ together is about 10 to about 100 per pyrazoloazole ring.

28. A silver halide color photographic material as in claim 1, wherein said regular crystals are cubic silver halide grains having an external shape surrounded by (100) planes or tetradecahedral grains having an external shape surrounded by (100) and (111) planes.

29. A silver halide color photographic material as in claim 1, wherein said silver halide is silver chlorobromide containing 10 mol % or more of silver bromide.

30. A silver halide color photographic material as in claim 1, wherein said silver halide is silver chlorobromide containing silver bromide of less than 10 mol %.

* * * * *